US011073148B2

(12) United States Patent
Coeckelbergs et al.

(10) Patent No.: US 11,073,148 B2
(45) Date of Patent: Jul. 27, 2021

(54) METHOD FOR CONTROLLING THE OUTLET TEMPERATURE OF AN OIL INJECTED COMPRESSOR OR VACUUM PUMP AND OIL INJECTED COMPRESSOR OR VACUUM PUMP IMPLEMENTING SUCH METHOD

(71) Applicant: Atlas Copco Airpower, Naamloze Vennootschap, Wilrijk (BE)

(72) Inventors: Joeri Coeckelbergs, Wilrijk (BE); Yun Shi, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 94 days.

(21) Appl. No.: 16/318,172

(22) PCT Filed: Aug. 8, 2017

(86) PCT No.: PCT/IB2017/054836
§ 371 (c)(1),
(2) Date: Jan. 16, 2019

(87) PCT Pub. No.: WO2018/033827
PCT Pub. Date: Feb. 22, 2018

(65) Prior Publication Data

US 2019/0249660 A1 Aug. 15, 2019

Related U.S. Application Data

(60) Provisional application No. 62/412,567, filed on Oct. 25, 2016, provisional application No. 62/376,550, (Continued)

(30) Foreign Application Priority Data

Feb. 3, 2017 (BE) ..... 2017/5069

(51) Int. Cl.
*F28F 27/00* (2006.01)
*F04B 49/06* (2006.01)
(Continued)

(52) U.S. Cl.
CPC ..... *F04B 49/065* (2013.01); *F04B 39/062* (2013.01); *F04B 49/06* (2013.01);
(Continued)

(58) Field of Classification Search
CPC ..... F28F 27/00; F04B 39/062; F04B 2205/11
See application file for complete search history.

(56) References Cited

U.S. PATENT DOCUMENTS 9,543,787 B2 * 1/2017 Duchesneau ..... F22B 1/00
10,724,524 B2 * 7/2020 Peters ..... F04C 29/026
(Continued)

FOREIGN PATENT DOCUMENTS

EP 1300637 A1 9/2003
JP 2006220342 A 8/2006
JP 2011005980 A 1/2011

OTHER PUBLICATIONS

International Search Report in related PCT Application No. PCT/IB2017/054836, dated Nov. 7, 2017.
(Continued)

*Primary Examiner* — Patrick Hamo
(74) *Attorney, Agent, or Firm* — Bacon & Thomas, PLLC

(57) ABSTRACT

The present invention is directed to a method for controlling the outlet temperature of an oil injected compressor or vacuum pump comprising a compressor or vacuum element provided with a gas inlet, an element outlet, and an oil inlet, said method comprising the steps of: measuring the outlet temperature at the element outlet; and controlling the position of a regulating valve in order to regulate the flow of oil flowing through a cooling unit connected to said oil inlet;
(Continued)

whereby the step of controlling the position of the regulating valve involves applying a fuzzy logic algorithm on the measured outlet temperature; and in that the method further comprises the step of controlling the speed of a fan cooling the oil flowing through the cooling unit by applying the fuzzy logic algorithm and further based on the position of the regulating valve.

16 Claims, 7 Drawing Sheets

Related U.S. Application Data filed on Aug. 18, 2016, provisional application No. 62/376,550, filed on Aug. 18, 2016.

(51) Int. Cl.

| | |
|---|---|
| ***F04C 28/00*** | (2006.01) |
| ***F04B 39/06*** | (2006.01) |
| ***F04D 29/00*** | (2006.01) |

(52) U.S. Cl.

CPC ..... *F04C 28/00* (2013.01); *F04D 29/00* (2013.01); *F28F 27/00* (2013.01); *F04B 2205/01* (2013.01); *F04B 2205/02* (2013.01); *F04B 2205/04* (2013.01); *F04B 2205/05* (2013.01); *F04B 2205/10* (2013.01); *F04B 2205/11* (2013.01); *F05B 2210/12* (2013.01); *F05B 2270/303* (2013.01); *F05B 2270/3011* (2013.01); *F05B 2270/3013* (2013.01)

(56) References Cited

U.S. PATENT DOCUMENTS

| | | | | |
|---|---|---|---|---|
| 2012/0090331 | A1 | 4/2012 | Bilton et al. | |
| 2016/0298883 | A1* | 10/2016 | Louvar | F25B 41/04 |
| 2018/0017062 | A1* | 1/2018 | Peters | F04C 29/0007 |

OTHER PUBLICATIONS

Written Opinion in related PCT Application No. PCT/IB2017/054836, dated Nov. 7, 2017.

* cited by examiner

METHOD FOR CONTROLLING THE OUTLET TEMPERATURE OF AN OIL INJECTED COMPRESSOR OR VACUUM PUMP AND OIL INJECTED COMPRESSOR OR VACUUM PUMP IMPLEMENTING SUCH METHOD

This invention relates to a method for controlling the outlet temperature of an oil injected compressor or vacuum pump comprising a compressor or vacuum element with a gas inlet, an element outlet, and an oil inlet, said method comprising the steps of: measuring the outlet temperature at the element outlet; and controlling the position of a regulating valve in order to regulate the flow of oil flowing through a cooling unit connected to said oil inlet.

BACKGROUND OF THE INVENTION

The need of keeping the temperature at the outlet of an oil injected compressor or vacuum pump to above a minimum limit is known.

Existing systems typically use a fixed temperature thermostat and a fixed speed fan making part of a cooling unit such that when the outlet temperature reaches the minimum limit, the system stops the fan until the outlet temperature increases.

If these systems would allow the outlet temperature to drop below such a limit, condensate would form within the system, which would negatively affect the cooling or lubrication capacity of the oil and would also have a corrosive effect, reducing the life span of the system.

At the same time, the outlet temperature should not be allowed to increase above an upper limit because damages can occur within the system, such as the quality of the oil can be deteriorated or even different components of the system can suffer deformations.

Tests have shown that, when using a fixed temperature thermostat and a fixed speed fan, the implemented solution is not always energy efficient. Even if the outlet temperature would not significantly exceed the upper limit, the fan would still be started at its fixed and maximum speed, causing the temperature to drop rapidly, typically below the minimum limit, bringing the system in a situation with increased risk of condensate formation.

Furthermore, because the fan would not have to function for an extensive period of time, such a fan would be switched on and off rapidly, affecting the motor driving it.

Other existing systems use a proportional integral derivative (PID) controller and a variable speed fan. Such systems applying separate control loops for controlling the thermostat and the fan.

Tests have shown that such systems can have an erratic and oscillating behavior because the two control loops interfere with one another. The consequence of such a behavior being the occurrence of emergency shut-downs, damages of the mechanical components and early wear of different system components.

Another drawback of systems using a PID controller is the fact that such a solution is suitable for one input-one output type of analysis, whereas tests have shown that the analysis performed on such systems can be more complex.

SUMMARY OF THE INVENTION

Taking the above mentioned drawbacks into account, it is an object of the present invention to provide a method for controlling the outlet temperature of an oil injected compressor or vacuum pump and avoiding condensate formation while avoiding at the same time an erratic and oscillating behavior.

The method according to the present invention aims at providing an energy efficient and easy to implement solution, even for existing oil injected compressors or vacuum pumps.

Moreover, the proposed solution is suitable to be implemented for multiple inputs-multiple outputs type of analysis.

The present invention aims at providing a solution continuously adapting to the changing environmental conditions and at the same time applicable to compressors or vacuum pumps located in any part of the world.

The present invention further aims at providing a compressor or vacuum pump having a minimum number of components, a minimum number of fittings and pipes, such that the maintenance process can be performed much easier.

The present invention solves at least one of the above and/or other problems by providing a method for controlling the outlet temperature of an oil injected compressor or vacuum pump comprising a compressor or vacuum element provided with a gas inlet, an element outlet, and an oil inlet, said method comprising the steps of:

measuring the outlet temperature at the element outlet;

controlling the position of a regulating valve in order to regulate the flow of oil flowing through a cooling unit connected to said oil inlet;

whereby the step of controlling the position of the regulating valve involves applying a fuzzy logic algorithm on the measured outlet temperature; and in that the method further comprises the step of controlling the speed of a fan cooling the oil flowing through the cooling unit by applying the fuzzy logic algorithm and further based on the position of the regulating valve.

By controlling the position of the regulating valve based on a fuzzy logic algorithm, the method is continuously adapting the path of the oil within the compressor or vacuum pump such that the cooling capacity is actively adapted in order to prevent condensate formation therein. Moreover, due to applying such a fuzzy logic algorithm taking into account the measured outlet temperature, the risk of condensate formation is minimized if not even eliminated.

Because the speed of the fan cooling the oil flowing through the cooling unit is also controlled by applying the fuzzy logic algorithm and based on the position of the regulating valve, such fan is started only when oil is reaching the cooling unit and the speed is controlled such that the compressor or vacuum pump is functioning at its highest efficiency, optimizing the energy consumption and at the same time continuously adapting to the current state of the compressor or vacuum pump.

Since the method is using a fuzzy logic algorithm having as input the measured outlet temperature for controlling the position of the regulating valve and the speed of the fan cooling the oil flowing through the cooling unit, the method according to the present invention is easily implementable on existing systems without the need of a substantial intervention and without massively impacting the user of such a compressor or vacuum pump. Such inlet and/or outlet temperature and/or pressure sensors being typically mounted within a compressor or vacuum pump.

Furthermore, since the method is using outlet temperature measurement, the method according to the present invention is continuously adapting to changing environmental conditions, eliminating the risk of condensate to appear within the compressor or vacuum pump and prolonging the lifetime of the oil used therein.

Moreover, if a user of the compressor or vacuum pump would transport the unit from one geographical location to another, he would be able to immediately use it, without the need of an intervention from a specialized engineer or a manual input of certain parameters, since the compressor or vacuum pump would immediately and automatically adapt to the specificities of the new location.

Another advantage of the present method is the fact that it uses a simple multiple input and multiple output algorithm that does not require a high computational power or specialized components.

Moreover, because the speed of the fan is controlled based on the position of the regulating valve and the measured outlet temperature, the risk of interferences between the control of the position of the regulating valve and the control of the speed of the fan is eliminated.

Preferably the step of controlling the position of said regulating valve involves regulating the flow of oil flowing through said cooling unit and through a bypass pipe fluidly connected to said oil inlet, for bypassing the cooling unit.

Because the path of the oil is chosen between a bypass pipe and the cooling unit, such cooling unit is only used when the temperature increases to a value at which a risk for the degradation of the oil or the degradation of the components part of the compressor or vacuum pump appears. Consequently, the method of the present invention is allowing for a prolonged lifetime of the components and is maintaining the frequency for performing maintenance interventions and the costs associated therewith very low.

Furthermore, because the path of the oil is chosen between a bypass pipe and a cooling unit before reaching the oil inlet, approximately the same volume of oil is being re-injected into the compressor or vacuum element at all times, maintaining constant lubrication and sealing properties.

The present invention is further directed to an oil injected compressor or vacuum pump comprising:

- a compressor or vacuum element having a gas inlet, an element outlet and an oil inlet;
- an oil separator having a separator inlet fluidly connected to the element outlet, a separator outlet and an oil outlet fluidly connected to an oil inlet of the compressor or vacuum element by means of an oil conduit;
- a cooling unit connected to the oil outlet of the oil separator and the oil inlet of the compressor or vacuum element;
- a bypass pipe fluidly connected to the oil outlet and to said oil inlet for bypassing the cooling unit;
- a regulating valve provided on the oil outlet configured to allow oil to flow from the oil separator through the cooling unit and/or through the bypass pipe;
- an outlet temperature sensor positioned at the element outlet;
- a controller unit controlling the position of said regulating valve;

whereby the cooling unit is provided with a fan and in that the controller unit is further provided with a fuzzy logic algorithm for controlling the speed of the fan based on the position of the regulating valve and measured outlet temperature, for maintaining the outlet temperature at approximately a predetermined target value.

Because the oil injected compressor or vacuum pump has such a structure, a minimum number of components, of pipes and fittings is used to obtain an efficient overall system.

The present invention is also directed to a controller unit for controlling the outlet temperature of an oil injected compressor or vacuum pump comprising a compressor or vacuum element provided with a gas inlet, an element outlet, and an oil inlet, said controller unit comprising:

- a measuring unit comprising a data input configured to receive outlet temperature data;
- a communication unit comprising a first data link for controlling the position of a regulating valve;

whereby

- the communication unit further comprises a second data link for controlling the rotational speed of a fan cooling the oil flowing through said cooling unit; and wherein
- the controller unit further comprises a processing unit provided with a fuzzy logic algorithm determining the speed of the fan based on the position of the regulating valve and the measured outlet temperature.

In the context of the present invention it should be understood that the benefits presented with respect to the method for maintaining the temperature at an outlet of the compressor or vacuum pump above a predetermined target value also apply for the oil injected compressor or vacuum pump and for the controller unit.

Furthermore, it should be understood that the benefit presented with respect to the oil injected compressor or vacuum pump also applies for the controller unit.

BRIEF DESCRIPTION OF THE DRAWINGS

With the intention of better showing the characteristics of the invention, some preferred configurations according to the present invention are described hereinafter by way of an example, without any limiting nature, with reference to the accompanying drawings, wherein.

DETAILED DESCRIPTION OF THE INVENTION

Figure 1:
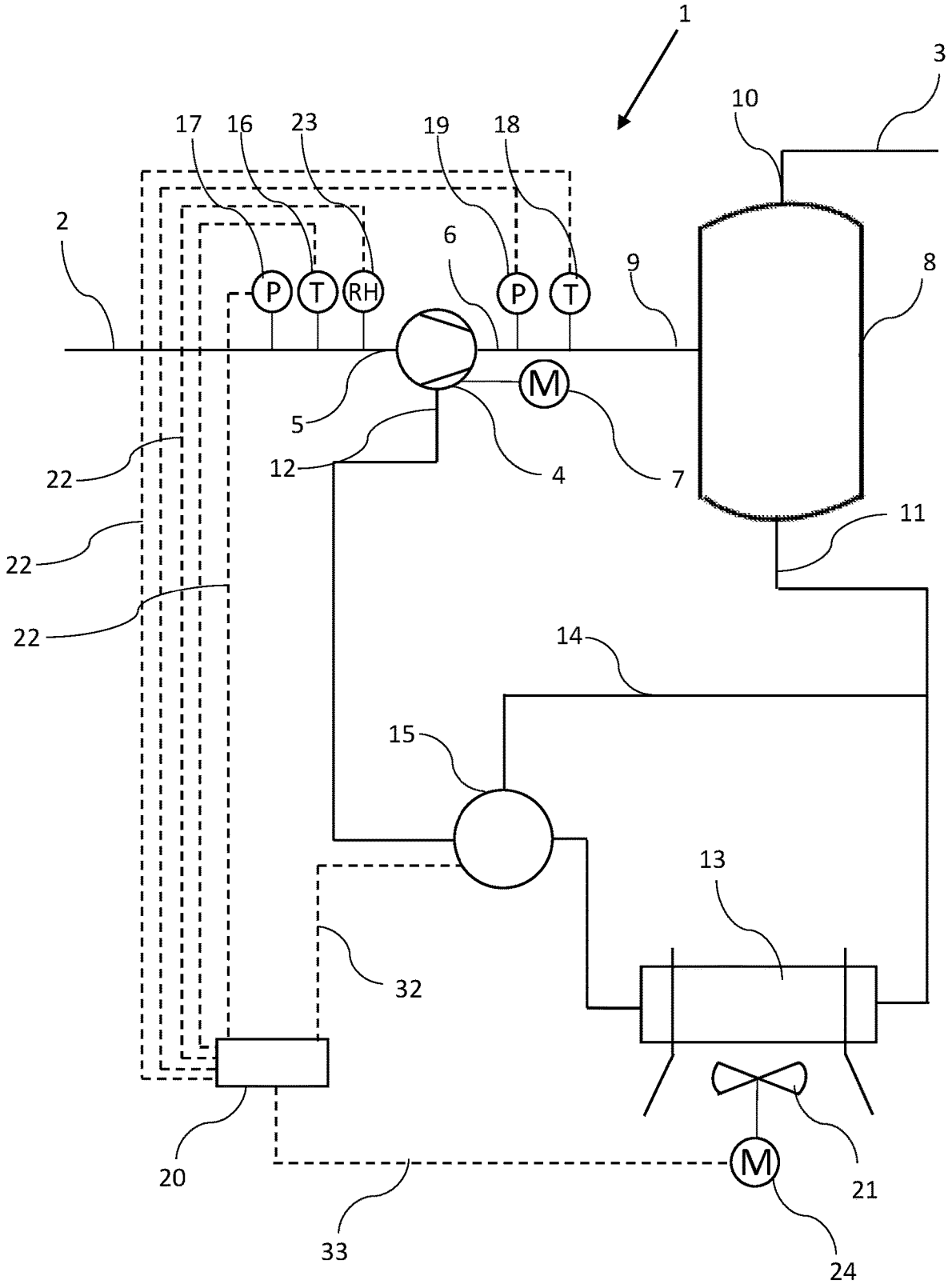
FIG. 1 schematically represents a compressor or vacuum pump according to an embodiment of the present invention.

FIG. 1 illustrates an oil injected compressor or vacuum pump 1 comprising a process gas inlet 2 and an outlet 3.

The compressor or vacuum pump 1 comprises a compressor or vacuum element 4 having a gas inlet 5 fluidly connected to the process gas inlet 2 and an element outlet 6 fluidly connected to the outlet 3.

In the context of the present invention the oil injected compressor or vacuum pump 1 should be understood as the complete compressor or vacuum pump installation, including the compressor or vacuum element 4, all the typical connection pipes and valves, the housing of the compressor or vacuum pump 1 and possibly the motor 7 driving the compressor or vacuum element 4.

In the context of the present invention, the compressor or vacuum element 4 should be understood as the compressor or vacuum element casing in which the compression or vacuum process takes place by means of a rotor or through a reciprocating movement.

In the context of the present invention, said compressor or vacuum element 4 can be selected from a group comprising: a screw, a toothed, a rotary vane, a piston, etc.

If the system comprises a compressor element, the process gas inlet 2 is typically connected to the atmosphere and the outlet 3 is fluidly connected to a user's network (not shown) through which clean compressed gas is provided.

If the system comprises a vacuum pump, the process gas inlet 2 is typically connected to a user's network (not shown) and the outlet 3 is typically connected to the atmosphere or to an external network (not shown), through which clean gas is evacuated and possibly reused.

The compressor or vacuum element 4 is driven by a motor 7 which can be a fixed speed motor or a variable speed motor.

The gas leaving the compressor or vacuum element 4 is directed through an oil separator 8 having a separator inlet 9 fluidly connected to the element outlet 6 and wherein the oil previously injected within the compressor or vacuum element 4 is separated from gas, before clean gas is being guided through a separator outlet 10 fluidly connected to the outlet 3 of the compressor or vacuum pump 1.

After the oil has been separated and collected within said oil separator 8, it is preferably allowed to flow through an oil outlet 11 fluidly connected to an oil inlet 12 of the compressor or vacuum element 4 by means of an oil conduit, through which said oil is re-injected within the compressor or vacuum element 4.

Typically, due to the compression or vacuum process, heat is generated, raising the temperature of the oil used for injection. Consequently, for cooling the oil when such temperature reaches or is raising above a predetermined target value, $T_{target}$, the compressor or vacuum pump 1 further comprises a cooling unit 13 connected to the oil outlet 11 of the oil separator 8 and the oil inlet 12 of the compressor or vacuum element 4.

Because the oil is reaching the predetermined target value, $T_{target}$, only after a period of time in which the compressor or vacuum element 4 is functioning, a bypass pipe 14 is also provided. Said bypass pipe 14 being fluidly connected to the oil outlet 11 and to the oil inlet 12 of the compressor or vacuum element 4 and allowing the flow of oil to bypass the cooling unit 13 and be directly re-injected within the oil inlet 12.

In the context of the present invention it should be understood that the bypass pipe 14 and the fluid conduit allowing oil to reach the cooling unit 13 are two similar pipes, fluidly connected to the oil outlet 11 through for example a T type of fitting, or said oil outlet 11 can comprise two separate pipes, one of them being the bypass pipe 14 and the other one being the fluid conduit allowing oil to reach the cooling unit 13.

Similarly, it should not be excluded that said oil inlet 12 can comprise two fluid conduits (not shown) or two injection points for the oil flowing through the oil outlet 12, one injection point allowing the oil flowing through the cooling unit 13 to be re-injected in the compressor or vacuum element 4, and an additional injection point allowing the oil flowing through the bypass pipe 14 to be re-injected in the compressor or vacuum element 4.

The compressor or vacuum pump 1 is further provided with a regulating valve 15 provided on the oil outlet 11 configured to allow oil to flow through the cooling unit 13.

Depending on how the modulating valve 15 is mounted within the compressor or vacuum pump 1, it can be further configured to allow oil to flow through the bypass pipe 14.

In another embodiment according to the present invention, and since the volume of oil flowing through the oil outlet 11 should be preferably maintained constant, the volume of oil flowing through the bypass pipe 14 is automatically regulated based on the volume of oil allowed to flow through the cooling unit 13.

Preferably, the regulating valve 15 is configured to control the path such oil is flowing through, before reaching the oil inlet 12.

Accordingly, the regulating valve 15 can be a three way valve allowing a fluid connection between the oil inlet 12 and the bypass pipe 14 and/or between the oil inlet 12 and the fluid conduit allowing oil to reach the cooling unit 13.

Consequently, the regulating valve 15 is allowing oil to flow from the oil separator 8 either through the cooling unit 13 or through the bypass pipe 14 or is simultaneously splitting the flow of oil: partially through the cooling unit 13 and partially through the bypass pipe 14.

For an accurate control of the path of the oil, the compressor or vacuum pump 1 is further provided with an outlet temperature sensor 19, positioned at the element outlet 6 for measuring the outlet temperature, $T_{out}$.

Preferably, but not limiting thereto, the compressor or vacuum pump 1 further comprises an inlet temperature sensor 16 and an inlet pressure sensor 17 positioned at the gas inlet 5 for measuring the inlet temperature and the inlet pressure of the gas, and outlet pressure sensor 19 positioned at the element outlet 6 flow conduit and measuring the outlet pressure of the gas.

Typically, for controlling the position of the regulating valve 15, a controller unit 20 is provided.

Such controller unit 20 preferably being part of the compressor or vacuum pump 1. It should be however not excluded that such controller unit 20 can be located remotely with respect to the compressor or vacuum pump 1, communicating with a local control unit part of the compressor or vacuum pump 1 through a wired or wireless connection.

In the context of the present invention, the position of the regulating valve 15 should be understood as the actual physical position such that the oil is allowed to flow through the bypass pipe 14 and/or through the cooling unit 13.

Depending on the type of regulating valve 15 used, such a position can modified through a rotating movement, a blocking or actuating type of action or through any other type of action allowing a flow to be controlled as previously explained.

For efficiently cooling the oil flowing through the cooling unit 13, a fan 21 is preferably provided in the vicinity of said cooling unit 13.

Furthermore, for maintaining the energy efficiency of the compressor or vacuum pump 1 and for maintaining the outlet temperature, $T_{out}$, at approximately a predetermined target value, $T_{target}$, such that the risk of condensate formation is minimized or even eliminated, the controller unit 20 is further provided with a fuzzy logic algorithm for controlling the speed of the fan 21 based on the position of the regulating valve 15 and measured outlet temperature, $T_{out}$.

In a preferred embodiment according to the present invention, the controller unit 20 further comprises a data link 22 for receiving measurements from each of said:

inlet temperature sensor 16, inlet pressure sensor 17, outlet temperature sensor 18 and outlet pressure sensor 19, said controller unit 20 being further provided with an algorithm for calculating the predetermined target value, $T_{target}$, by considering a calculated atmospheric dew point, ADP, based on the received measurements.

In the context of the present invention, said data link 22 should be understood as wired or wireless data link between the controller unit 20 and each of said: inlet temperature sensor 16, inlet pressure sensor 17, outlet temperature sensor 18 and outlet pressure sensor 19.

In an embodiment according to the present invention, for an even more accurate calculation of the conditions of the compressor or vacuum pump 1, a relative humidity sensor 23 is positioned at the gas inlet 5, the measurements of which are preferably being sent to said controller unit 20 through a data link 22.

Alternatively, the controller unit 20 can comprise means to approximate the relative humidity, RH, of the gas flowing through the gas inlet 5 or the data input of said controller unit 20 can be further configured to receive a measurement of relative humidity, RH, from an external relative humidity sensor not part of the compressor or vacuum pump 1 or from an external network.

In a preferred embodiment according to the present invention, but not limiting thereto, the controller unit 20 comprises means for controlling the speed of the fan 21 based on the current position of the regulating valve 15 and a first error, $e_1$, calculated by subtracting the predetermined target value, $T_{target}$, from a first measured outlet temperature, $T_{out,1}$, from:

$$e_1 = T_{out,1} - T_{target} \quad \text{(equation 1).}$$

In the context of the present invention, said means for controlling the speed of the fan 21 should be understood as an electrical signal generated by said controller unit 20 through a wired or wireless connection between the controller unit 20 and the fan 21. The electrical signal allowing for an increase or decrease of its rotational speed.

For an easier and more accurate control of the speed of the fan 21, said fan 21 is provided with a variable speed motor 24.

More specifically, said controller unit 20 is generating an electrical signal through the second data link 33 to a frequency converter (not shown) of the motor driving said fan 21. The motor comprising a shaft connected to the shaft of the fan 21 or said shaft being the shaft of said fan 21.

Accordingly, the frequency converter translates the electrical signal from the controller unit 20 into a signal generating an increase or decrease of speed for the motor, which signal influences the rotational speed of the shaft and consequently the rotational speed with which the fan is rotating.

Preferably, the controller unit 20 comprises a memory module (not shown) for storing the current position of the regulating valve 15.

The controller unit 20 retrieving the last saved current position of said regulating valve 15 from the memory module, uses such a current position in the fuzzy logic algorithm and controls the speed of the fan 21 such that the outlet temperature ($T_{out}$) is maintained at approximately a predetermined target value ($T_{target}$).

If the position of the regulating valve 15 is changed, the controller unit 20 preferably saves the changed position as the last current position of said regulating valve 15 onto said memory module.

It should be understood that other variants are also possible, such as for example and not limiting thereto, the controller unit 20 can further comprise a position sensor or a servomotor or other means for determining the current position of the regulating valve 15.

Figure 2:
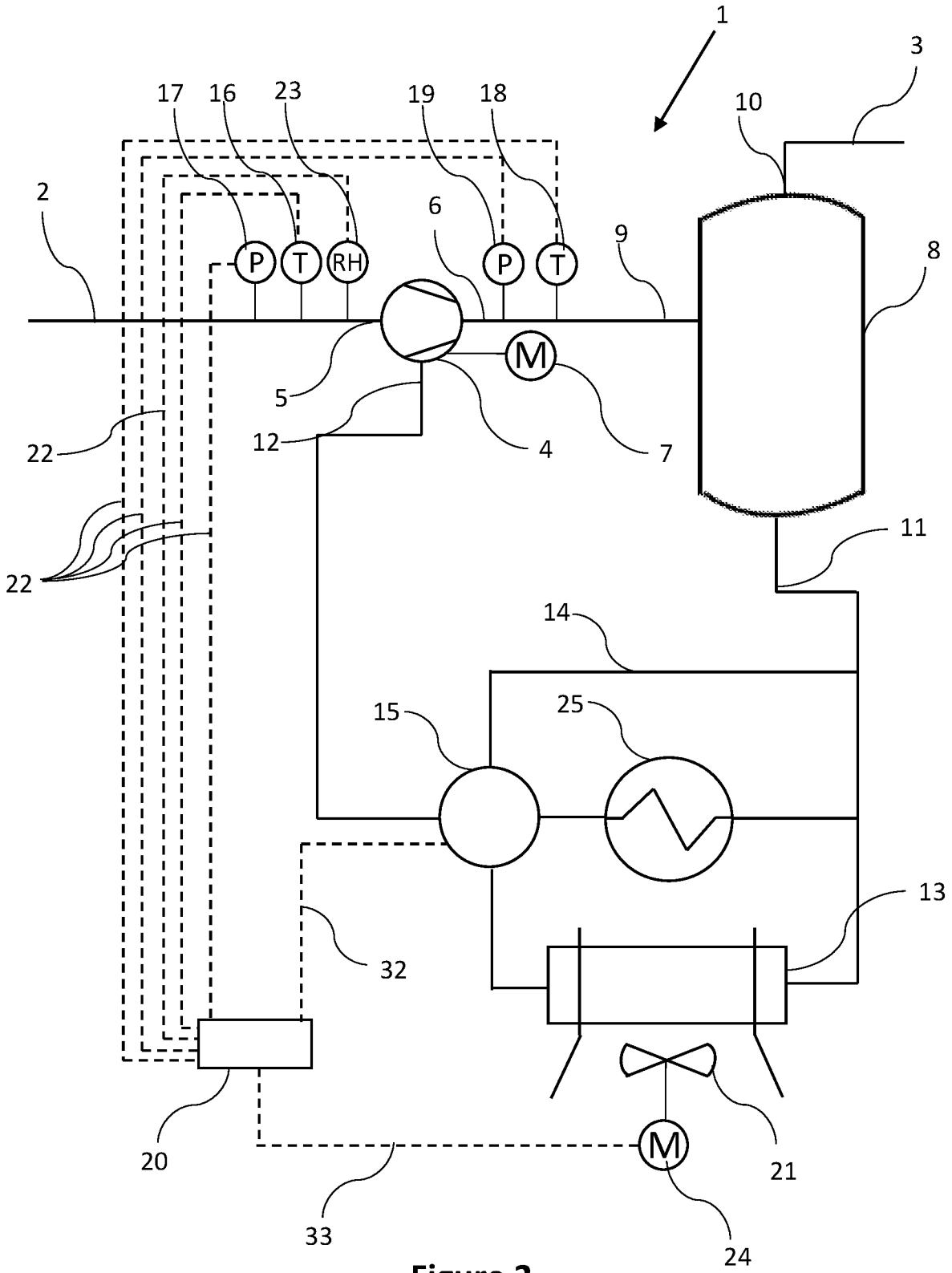
FIG. 2 schematically represents a compressor or vacuum pump according to another embodiment of the present invention.

In another embodiment according to the present invention and as illustrated in FIG. 2, for reusing the heat generated through the compression or vacuum process, the compressor or vacuum pump 1 further comprises an energy recovering unit 25 connected to the oil outlet 11 and the oil inlet 12.

Such energy recovering unit 25 being capable of transferring the heat captured by the oil to another medium such as for example: a gaseous or liquid medium or to a phase change material and use the transferred heat or generated energy for heating an object or for heating water, within the heating system of a room, or for generating electric energy, or the like.

By including said energy recovering unit 25, the energy footprint of the compressor or vacuum pump 1 is even more reduced since instead of immediately starting a fan, the heat transfer between two mediums is implemented and further used, making the compressor or vacuum pump according to the present invention environmentally friendly.

Figure 3:
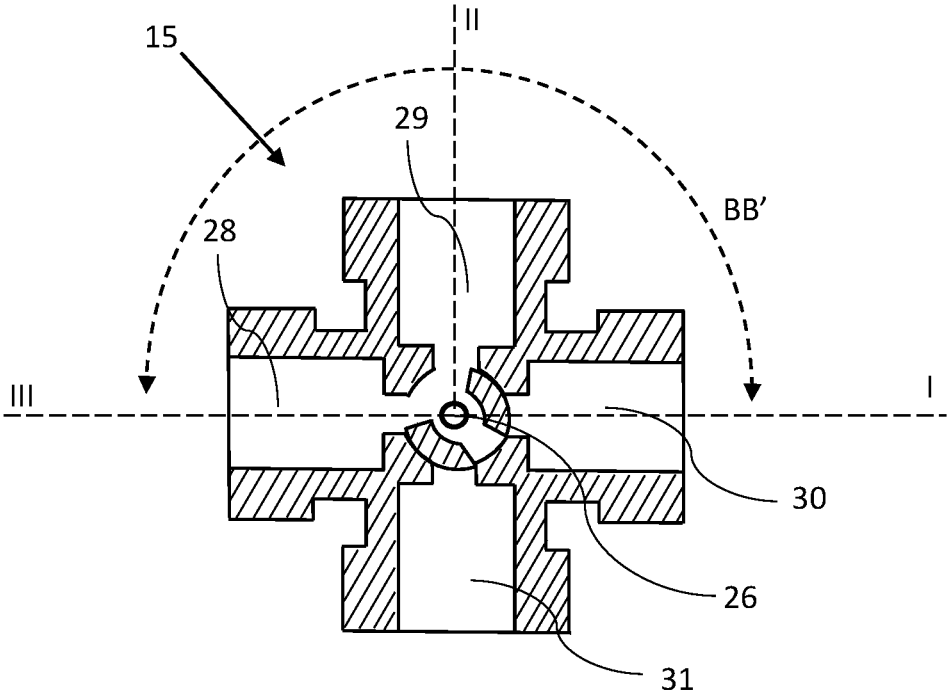
FIG. 3 schematically represents a regulating valve according to an embodiment of the present invention.

For explanatory purposes only, and not limiting thereto, the regulating valve 15 according to the present invention is a rotating valve, as illustrated in FIG. 3. Such regulating valve 15 having four channels and a central rotating element 26 allowing for two or more channels to be blocked or partially blocked, such that fluid is not allowed to flow therethrough or is partially allowed to flow therethrough.

Such a layout for a regulating valve 15 should however not be considered limiting and it should be understood that any other type of valve capable of blocking or partially blocking two or more fluid channels could be used herein.

Figure 4:
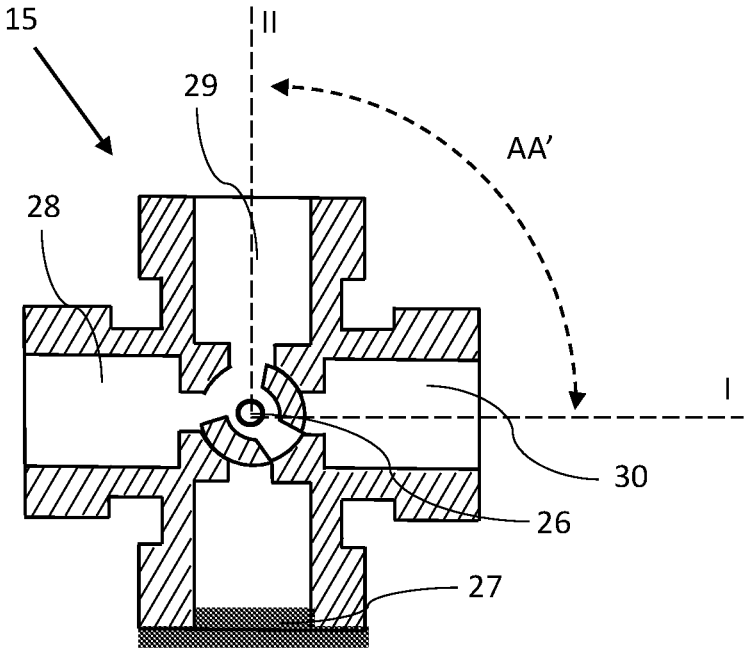
FIG. 4 schematically represents a regulating valve according to an embodiment of the present invention.

If the compressor or vacuum pump 1 comprises an energy recovering unit 25, the regulating valve 15 can have the layout as illustrated in FIG. 3. If the compressor or vacuum pump 1 does not comprise an energy recovering unit 25, then the regulating valve 15 can have the layout as illustrated in FIG. 4, wherein one of the four channels is preferably blocked by a plug 27.

Returning now to FIG. 3, a first channel 28 is in fluid connection with the oil inlet 12, a second channel 29 is in fluid connection with the bypass pipe 14, a third channel 30 is in fluid connection with the cooling unit 13 and a fourth channel 31 is in fluid connection with the energy recovering unit 25.

In another embodiment according to the present invention, for a more accurate control of the position of the regulating valve 15, the controller unit 20 is further provided with means for calculating an evolution of the error, d(error)/dt. Such evolution of the error, d(error)/dt, determining if the error is decreasing or increasing within a predetermined time interval.

In the context of the present invention, said means of calculating the evolution of the error, d(error)/dt, should be understood as an algorithm with which said controller unit 20 is provided.

Accordingly, for calculating said evolution of the error, d(error)/dt, the controller unit 20 preferably receives two subsequent outlet temperature measurements, $T_{out,1}$ and $T_{out,2}$, determines two subsequent errors: a first error, $e_1$, and a second error, $e_2$, by subtracting the predetermined target value, $T_{target}$, from the first measured outlet temperature, $T_{out,1}$, ($e_1$) and by subtracting the predetermined target value, $T_{target}$ from the subsequent measured outlet temperature, $T_{out,2}$, ($e_2$). Further, the controller unit 20 subtracts the calculated first error, $e_1$, from a subsequent calculated second error, $e_2$ and divides it over the time interval, Δt, determined between the moment, $t_1$, when the first outlet temperature, $T_{out,1}$, is measured and the moment, $t_2$, when the subsequent outlet temperature, $T_{out,2}$, is measured:

$$e_2 = T_{out,2} - T_{target}; \quad \text{(equation 2)}$$

$$d(\text{error})/dt = \frac{e_2 - e_1}{\Delta t}; \quad \text{(equation 3)}$$

$$\Delta t = t_2 - t_1. \quad \text{(equation 4)}$$

Consequently, based on the measured outlet temperature, $T_{out}$, and an evolution of the error, d(error)/dt, the controller unit 20 comprises means to modify the position of the regulating valve 15 such that oil is allowed to flow through the energy recovering unit 25.

In the context of the present invention, it should be understood that said controller unit 20 is capable of receiving measurements, performing calculations, possibly sending calculated parameters to other components part of the compressor or vacuum pump 1 or to an external computer, and generating electrical signals for influencing the working conditions of other components part of the compressor or vacuum pump 1.

Accordingly, the controller unit 20 can comprise a measuring unit comprising a data input configured to receive: inlet temperature data inlet pressure data, and outlet pressure data from the respective: inlet temperature sensor 16, inlet pressure sensor 17 and outlet pressure sensor 19.

The controller unit 20 can further comprise a communication unit having a first data link 32 for controlling the position of a regulating valve 15 such that oil is allowed to flow through the oil cooling unit 13 and/or through a bypass pipe 14 and/or through the energy recovering unit 25.

The controller unit further comprises a second data link for controlling the rotational speed of the fan 21 cooling the oil flowing through said cooling unit 13.

In the context of the present invention it should be understood that said second data link 33 can communicate with an electronic module (not shown) positioned at the level of the fan 21 or can communicate directly with the motor 24 or with an electronic module (not shown) at the level of the motor 24 driving such fan 21.

Preferably, the controller unit 20 further comprises a processing unit provided with a fuzzy logic algorithm for determining the speed of the fan 21 based on the position of the regulating valve 15 and the measured inlet and/or outlet temperature ($T_{in}$, $T_{out}$) and/or pressure ($P_{in}$, $P_{out}$).

Further, the processing unit can be provided with an algorithm for calculating the predetermined target value, $T_{target}$, by considering a calculated atmospheric dew point, ADP, based on the measurements received from the measuring unit.

In another embodiment according to the present invention, the processing unit is further being provided with an algorithm for determining the first error, $e^1$, by applying equation 1.

Further, for determining the atmospheric dew point, ADP, the processing unit can use a predetermined relative humidity, RH, value or a relative humidity, RH, measurement provided by the relative humidity sensor 23 positioned at the gas inlet 5.

In another embodiment according to the present invention the controller unit 20 can apply a predetermined time interval, Δt, otherwise known as sampling rate, between two subsequent measurements of temperature, pressure and/or relative humidity.

In the context of the present invention it should be understood that the sampling rate, Δt, can be chosen to be the same for all the parameters, or can be different for one or more of the measured parameters, depending on the requirements of the user's network and the needed responsiveness for the compressor or vacuum pump 1.

Depending on the capabilities of the controller unit 20, such sampling rate, Δt, can be any value selected between 1 millisecond and 1 second. Preferably, the sampling rate, Δt, is selected to be less than 60 milliseconds, more preferably less than 50 milliseconds.

Even more preferably, the measuring unit applies a sampling rate of approximately 40 milliseconds between two subsequent measurements.

Tests have shown that if the measured outlet temperature, $T_{out}$, is maintained at approximately the determined atmospheric dew point, ADP, or if such a value is exceeded by a relatively small value, the oil injected compressor or vacuum pump 1 is still functioning efficiently and the quality and lifetime of the oil or its components is not affected.

Accordingly, the controller unit 20 is preferably choosing the predetermined target value, $T_{target}$, by adding a predetermined tolerance, $T_{offset}$, to the determined atmospheric dew point, ADP.

Such predetermined tolerance, $T_{offset}$, can be chosen depending on the requirements of the oil injected compressor or vacuum pump 1 and can be further manually inserted into the controller unit through for example a user interface (not shown) or can be sent through a wired or wireless connection to said controller unit 20 from an on-site or off-site computer.

It should be further understood that the value of the predetermined tolerance, $T_{offset}$, and implicitly of the predetermined target value, $T_{target}$, can be changed throughout the lifetime of the compressor or vacuum pump 1, depending on the requirements of the user's network.

The method for controlling the outlet temperature, $T_{out}$, of the oil injected compressor or vacuum pump 1 is very simple and as follows.

Said predetermined target value, $T_{target}$, can be either a pre-calculated value which can be introduced or sent to the oil injected compressor or vacuum pump 1, or can be determined by the system.

In another embodiment according to the present invention, said predetermined target value, $T_{target}$, can be determined by measuring the inlet temperature, $T_{in}$, and the inlet pressure, $P_{in}$, through an inlet temperature sensor 16 and an inlet pressure sensor 17 and measuring the outlet temperature, $T_{out}$, and the outlet pressure, $P_{out}$, at the element outlet 6 through an outlet temperature sensor 18 and an outlet pressure sensor 19.

The method according to the present invention aims to maintain the temperature at an outlet 3 of the oil injected compressor or vacuum pump 1 at approximately the predetermined target value, $T_{target}$, by controlling the position of the regulating valve 15 in order to regulate the flow of oil through the cooling unit 13.

Whereby the step of controlling the position of the regulating valve 15 involves applying a fuzzy logic algorithm on the measured outlet temperature, $T_{out}$, and possibly on one or more of the following: measured inlet temperature, $T_{in}$, measured inlet pressure, $P_{in}$, and measured outlet pressure, $P_{out}$.

In one embodiment according to the present invention and not limiting thereto, the predetermined target value, $T_{target}$, can be determined by calculating the atmospheric dew point, ADP.

One method of calculating said atmospheric dew point, ADP, is by applying the following formula:

$$ADP = \frac{T_n}{\left[\frac{m}{\log_{10}\left(\frac{p_{wpres}}{A}\right)} - 1\right]}. \quad \text{(equation 5)}$$

Wherein, A, m and $T_n$ are empirically determined constants and can be chosen from Table 1, according to the specific temperature range at which the compressor or vacuum pump 1 functions.

TABLE 1

| | A | m | $T_n$ | max error | Temperature range |
|---|---|---|---|---|---|
| water | 6.116441 | 7.591386 | 240.7263 | 0.083% | (−20° C. to +50° C.) |
| | 6.004918 | 7.337936 | 229.3975 | 0.017% | (+50° C. to +100° C.) |
| | 5.856548 | 7.27731 | 225.1033 | 0.003% | (+100° C. to +150° C.) |
| | 6.002859 | 7.290361 | 227.1704 | 0.007% | (+150° C. to +200° C.) |
| | 9.980622 | 7.388931 | 263.1239 | 0.395% | (+200° C. to +350° C.) |
| | 6.089613 | 7.33502 | 230.3921 | 0.368% | (0° C. to +200° C.) |
| ice | 6.114742 | 9.778707 | 273.1466 | 0.052% | (−70° C. to 0° C.) |

Such empirically determined constants having the following measurement units: A for example represents the water vapor pressure at 0° C. and has as measurement unit in Table 1: hectopascal (hPa), m is an adjustment constant without a measurement unit, whereas $T_n$ is also an adjustment constant having degrees Celsius (° C.) as measurement unit.

$p_{wpres}$ from equation 5 represents the water vapor pressure converted to atmospheric conditions and can be calculated by applying the following formula:

$$p_{wpres} = \frac{P_{out}}{p_{in}} \cdot RH \cdot P_{ws}; \quad \text{(equation 6)}$$

whereby $P_{out}$ is the measured outlet pressure, $P_{in}$ is the measured inlet pressure, RH is the relative humidity either approximated or measured (if the system comprises a relative humidity sensor 23) and $p_{ws}$ represents the water vapor saturation pressure.

If the system does not comprise a relative humidity sensor 23, the approximated relative humidity, RH, can be selected as approximately 100% or lower.

Alternatively, the compressor or vacuum pump 1 can receive a relative humidity, RH, measurement from a sensor positioned in the vicinity of the compressor or vacuum pump or can receive such measurement from an external network.

Preferably, if the system comprises a compressor, the relative humidity, RH, is the relative humidity of the ambient air if the gas inlet 2 is connected to the atmosphere or is the relative humidity characteristic for an external network if the gas inlet 2 is connected to such external network.

Further preferably, if the system comprises a vacuum pump, the relative humidity, RH, is the relative humidity of the process the gas inlet 2 is connected to, the process being the user's network.

The water vapor saturation pressure, $p_{ws}$, can be calculated by applying the following formula:

$$p_{ws} = A \cdot 10^{\frac{m \cdot T_{in}}{T_{in} + T_n}}; \quad \text{(equation 7)}$$

wherein $T_{in}$ is the measured inlet temperature and A, m and $T_n$ are the empirically determined constants found in Table 1.

In the context of the present invention, the above identified method of calculating the atmospheric dew point, ADP, should not be considering limiting and it should be understood that any other method of calculation can be applied without departing from the scope of the present invention.

In another embodiment according to the present invention, the predetermined target value, $T_{target}$ is determined by considering a maximum temperature at which different components part of the oil injected compressor or vacuum pump 1 can function in normal parameters, such maximum temperature depending on the materials used for their manufacture or their properties and how such properties change with the increase in temperature.

Such maximum temperature can be for example: the maximum temperature of the oil at which its viscosity, oil stability and degradation over time are maintained within desired values, or the maximum temperature at which the regulating valve can function without the risk of deformation due to the material used for its manufacture, or the maximum temperature the housing of the compressor or vacuum element 4 or the compressor or vacuum element 4 itself can withstand without the risks of material deformations, or the maximum temperature that any bearings or seals mounted within the compressor or vacuum pump can withstand, or the maximum temperature at which the temperature and/or pressure sensors can function without the risk of degradation, or a maximum temperature characteristic for a normal functioning of the pipes and fittings part of the compressor or vacuum pump 1, or the like.

In yet another embodiment according to the present invention and not limiting thereto, the method further comprises the step of comparing the calculated predetermined target value, $T_{target}$, with the lowest of the maximum temperatures characteristic for the different components, as defined above, and if the calculated predetermined target value, $T_{target}$, is higher than said lowest maximum temperature, then the method will consider said lowest maximum temperature as the calculated predetermined target value, $T_{target}$.

Alternatively, the method will use for further comparisons and calculations, the calculated predetermined target value, $T_{target}$.

Depending on the requirements and responsiveness of the compressor or vacuum pump 1, the calculated predetermined target value, $T_{target}$ can be chosen to be equal to the calculated atmospheric dew point, ADP, or the method according to the present invention further comprises the step of adding a tolerance, $T_{offset}$, to said calculated atmospheric dew point, ADP.

Such tolerance, $T_{offset}$, can be any value selected between 1° C. and 10° C., more preferably between 1° C. and 7° C., even more preferably, between 2° C. and 5° C.

Tests have shown that if the tolerance does not exceed the above mentioned values, the efficiency of the compressor or vacuum pump 1 is maintained, the oil quality and the stability of the overall system is assured.

Preferably, but not limiting thereto, for further avoiding the condensate formation and maintaining the energy efficiency of compressor or vacuum pump 1, the predetermined target value, $T_{target}$, is preferably maintained between a minimum limit, $T_{target,min}$, and a maximum limit, $T_{target,max}$.

Accordingly, the predetermined target value, $T_{target}$, is compared with the minimum limit, $T_{target,min}$, and if the predetermined target value, $T_{target}$, is lower than the minimum limit, $T_{target,min}$, the predetermined target value, $T_{target}$, is selected as being equal to the minimum limit, $T_{target,min}$. Similarly, if the predetermined target value, $T_{target}$, is higher than the maximum limit, $T_{target,max}$, the predetermined target value, $T_{target}$, is selected as being equal to the maximum limit, $T_{target,max}$.

As an example, if the system comprises a vacuum element, the minimum limit, $T_{target,min}$, can be selected as any value comprised between 60° C. and 80° C., preferably between 70° C. and 80° C., even more preferably, the minimum limit can be selected at approximately 75° C. or lower and the maximum limit, $T_{target,max}$, can be selected at approximately 100° C. or lower.

Further, if the system comprises a compressor element, the minimum limit, $T_{target,min}$, can be selected as any value comprised between 50° C. and 70° C., preferably between 55° C. and 65° C., even more preferably, the minimum limit can be selected at approximately 60° C. or lower and the maximum limit, $T_{target,max}$, can be selected at approximately 110° C. or lower.

Further, the fuzzy logic algorithm implemented by the method according to the present invention comprises the step of determining a first error, $e_1$, by subtracting the predetermined target value, $T_{target}$, from a first measured outlet temperature, $T_{out,1}$.

Further, the fuzzy logic algorithm comprises the step of determining a second error, $e_2$, by subtracting the predetermined target value, $T_{target}$, from a subsequent measured outlet temperature, $T_{out,2}$.

For an accurate determination of the condition of the overall system, the fuzzy logic algorithm further comprises the step of calculating the evolution of the error, d(error)/dt, over the sampling rate, by calculating the derivative of the error over time. Accordingly, the second error, e2, is subtracted from the first error, e1, and the result is divided over the sampling rate, Δt. Said sampling rate, Δt, should be understood as a time interval, Δt, calculated between the moment, $t_1$, when the first outlet temperature, $T_{out,1}$, is measured and the moment, $t_2$, when the subsequent outlet temperature, $T_{out,2}$, is measured.

Preferably but not limiting thereto, the sampling rate is chosen at 40 milliseconds.

Preferably, the fuzzy logic algorithm further comprises the step of determining the direction towards which the position of the regulating valve 15 should change according to the first error, $e_1$, or the second error, $e_2$, and the evolution of the error, d(error)/dt.

Further preferably, the fuzzy logic algorithm further comprises the step of determining the speed rate with which the position of the regulating valve should be changed based on the first error (e1) or the second error (e2), and the evolution of the error (d(error)/dt).

In another embodiment according to the present invention, for achieving a more stable compressor or vacuum pump 1, the fuzzy logic algorithm can further comprise at least one filter, such as for example a Low Pass Filter (LPF), for filtering short time fluctuations of temperature.

Such LPF being designed to disregard temperature fluctuations lasting for example for less than one second or less than approximately five seconds, more preferably the LPF is designed to disregard temperature fluctuations lasting for less than two seconds, even more preferably, the LPF is designed to disregard temperature fluctuations lasting for less than approximately three seconds.

In yet another embodiment according to the present invention, the fuzzy logic algorithm assigns membership functions for determining the logical output and for further using the calculated first error, $e_1$, or second error, $e_2$, and of the evolution of the error, d(error)/dt.

Figure 5:
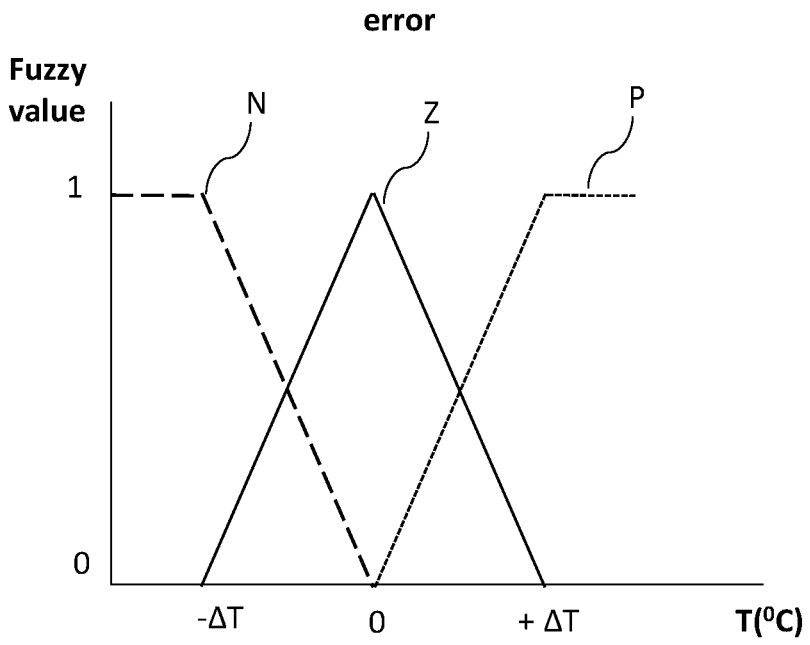
FIG. 5 schematically represents the graphical representation of the membership functions associated with the error according to an embodiment of the present invention.
Figure 6:
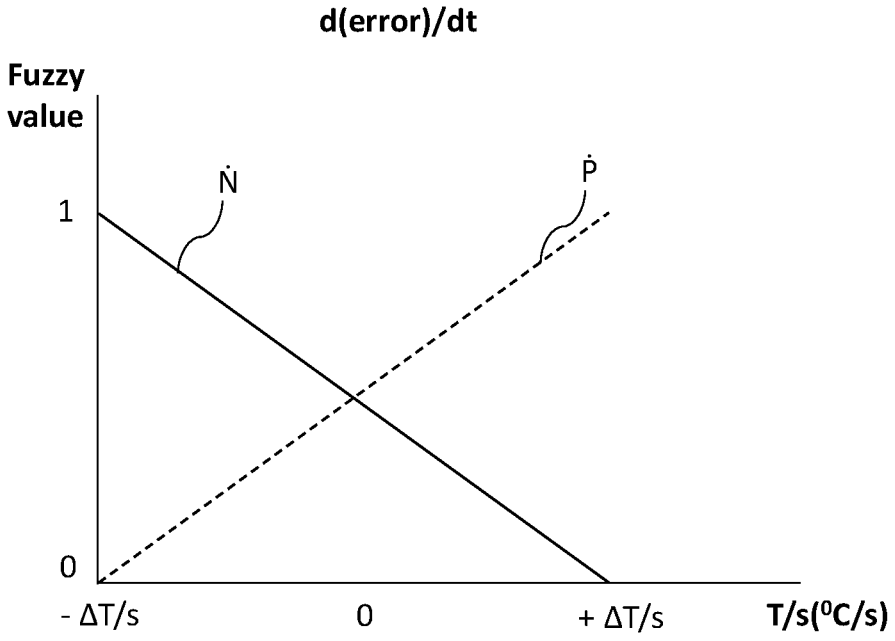
FIG. 6 schematically represents the graphical representation of the membership functions associated with the evolution of the error according to an embodiment of the present invention.

An example for a graphical representation of such membership functions is illustrated in FIG. 5, for the error and in FIG. 6, for the evolution of the error, d(error)/dt. The error being represented as a corresponding fuzzy value as a function of temperature, T, having degrees Celsius (° C.) as measurement unit. Whereas the evolution of the error, d(error)/dt, being represented as a corresponding fuzzy value as a function of temperature, T, over seconds, s, having degrees Celsius over seconds (° C./s) as measurement unit. Such membership functions being identified as N, Z and P for the graphs illustrated in FIG. 5, wherein N stands for Negative, Z stands for Zero, for which the measured outlet temperature, $T_{out}$, is equal or approximately equal to the predetermined target value, $T_{target}$, and P stands for Positive.

In the same manner, the membership functions are being identified as $\dot{N}$ and $\dot{P}$ for the graphs illustrated in FIG. 6, wherein $\dot{N}$ stands for negative and $\dot{P}$ stands for positive.

The temperature interval [−ΔT; +ΔT] is chosen in accordance with the specificities of the compressor or vacuum pump 1 and such a parameter can be changed. As an example and not limiting thereto, −ΔT can be any value selected between −10° C. and −1° C., more preferably, −ΔT can be any value selected between −8° C. and −5° C., even more preferably, −ΔT can be selected as approximately −8° C.

In the same manner, +ΔT can be any value selected between +1° C. and +10° C., more preferably, +ΔT can be any value selected between +5° C. and +8° C., even more preferably, +ΔT can be selected as approximately +5° C.

In the context of the present invention the values selected for −ΔT and +ΔT should be considered as an example only and the present invention should not be limited to these particular values, any other values can be selected without affecting the logic of the method according to the present invention.

Accordingly, if the calculated error has a negative value, such value is to be represented within the N graph of FIG.

5 at the corresponding outlet temperature. If the calculated error is approximately equal to zero and the measured outlet temperature, $T_{out}$, is approximately equal to the predetermined target value, $T_{target}$, such a value is to be represented within the Z graph at the corresponding temperature. Alternatively, if the calculated error is positive, such a value is to be represented within the P graph, at the corresponding temperature.

In the same manner, if the evolution of the error is negative, such value is to be represented within the n graph of FIG. 6, whereas if the evolution of the error is positive, such a value is to be represented within the $\dot{P}$ graph. Such values being represented at a corresponding temperature $T_{out,2}-T_{out,1}$ over the time difference $\Delta t$.

Accordingly, the determined fuzzy values with respect to the error and the evolution of the error, d(error)/dt, are further used by the fuzzy logic algorithm for determining the direction in which the regulating valve 15 is to be changed. Such fuzzy values being any real number selected within the interval [0;1] and in accordance with the calculated error or evolution of the error, d(error)/dt.

Accordingly, if the second error, $e_2$, is negative, N, or if the second error, $e_2$, is approximately equal to zero, being represented on the Z graph as previously explained, and the evolution of the error, d(error)/dt, is negative, $\dot{N}$, meaning that the temperature of the oil is decreasing, such that it can be re-injected within the compressor or vacuum element, the direction in which the position of the regulating valve 15 is to be changed is such that more oil is to be allowed to flow through the bypass pipe 14.

Alternatively, if the second error, $e_2$, is positive, P, or if the second error, $e_2$, is approximately equal to zero, being represented on the Z graph, and the evolution of the error, d(error)/dt, is positive, $\dot{P}$, meaning that the temperature of the oil is showing an increase between two subsequent outlet temperature measurements, $T_{out,1}$ and $T_{out,2}$, the direction in which the position of the regulating valve 15 is to be changed is such that more oil is flowing through the cooling unit 13.

In another embodiment according to the present invention, the fuzzy logic algorithm determines the speed rate with which the position of the regulating valve 15 is to be changed. Depending on the error and the evolution of the error and depending on the required responsiveness of the overall system, the fuzzy logic algorithm might consider different speed rates for changing the position of the regulating valve 15. Equal speed rates should however not be excluded.

Accordingly, if the second error, $e_2$, is negative, N, and the evolution of the error, d(error)/dt, is negative, $\dot{N}$, the position of the regulating valve 15 can be changed at a first predetermined speed rate, −L; or if the second error, $e_2$, is negative, N, and the evolution of the error, d(error)/dt is positive, $\dot{P}$, the position of the regulating valve 15 can be changed at a second predetermined speed rate, −M; or if the second error, $e_2$, is approximately equal to zero, Z, and the evolution of the error, d(error)/dt, is negative, $\dot{N}$, the position of the regulating valve 15 can be changed at a third predetermined speed rate, −S; or if the second error, $e_2$, is approximately equal to zero, Z, and the evolution of the error, d(error)/dt, is positive, $\dot{P}$, the position of the regulating valve 15 can be changed at a fourth predetermined speed rate, +S; or if the second error, $e_2$, is positive, P, and the evolution of the error, d(error)/dt, is negative, $\dot{N}$, the position of the regulating valve 15 can be changed at a fifth predetermined speed rate, +M; or if the second error, $e_2$, is positive, P, and the evolution of the error, d(error)/dt, is positive, $\dot{P}$, the position of the regulating valve 15 can be changed at a sixth predetermined speed rate, +L.

Figure 7:
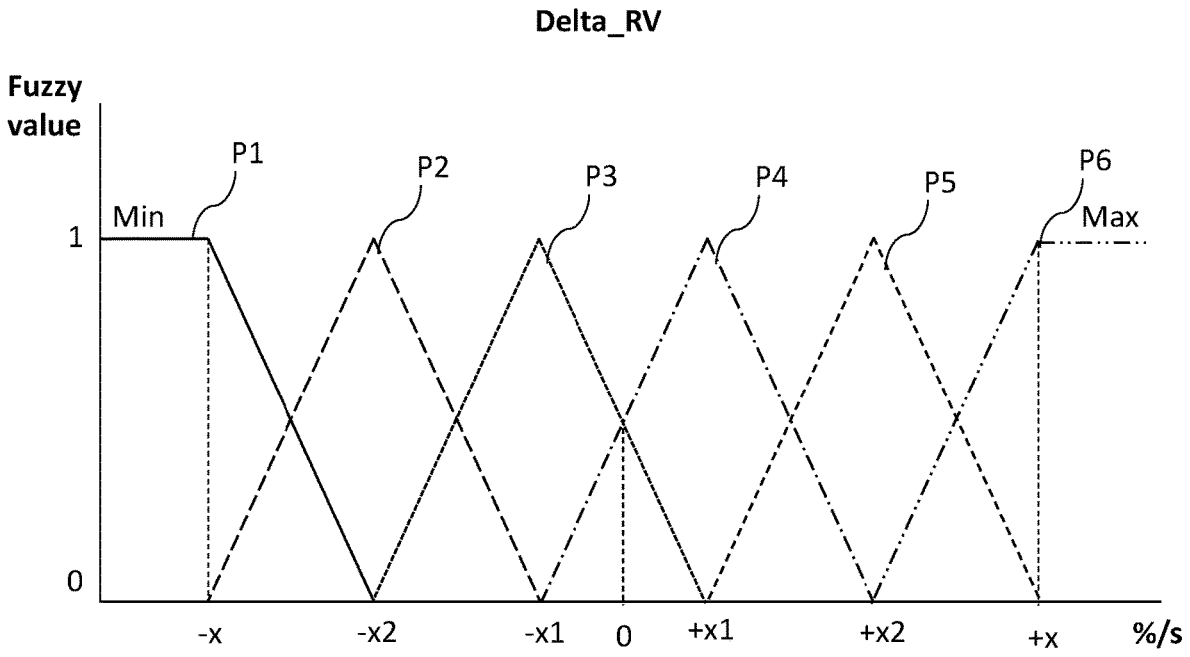
FIG. 7 schematically represents the graphical representation of the membership functions associated with the change of the angle of the regulating valve (Delta_RV) according to an embodiment of the present invention.

As an example and not limiting thereto, the direction in which the regulating valve 15 is to be changed and the speed with which such a change should be performed, can be governed by Table 2, wherein P1 to P6 are the membership functions as illustrated in FIG. 7. Such membership functions being represented in FIG. 7 as the corresponding fuzzy values and as a function of the speed with which the change should be performed, represented in percentage per second, %/s, whereby the percentage represents the angle of rotation.

TABLE 2

| | | error | | |
|---|---|---|---|---|
| Delta RV | | N | Z | P |
| d(error)/dt | $\dot{N}$ | P1 (−L) | P3 (−S) | P5 (+M) |
| | $\dot{P}$ | P2 (−M) | P4 (+S) | P6 (+L) |

In an embodiment according to the present invention, the membership functions P1 to P6 can be chosen such that, for example, P1 to P3 can be assigned for the situation in which the temperature of the oil is not high enough such that no additional volume of oil should be allowed to flow through the cooling unit 13, whereas P4 to P6 can be assigned for the situation in which the temperature of the oil is high enough to justify an additional volume of oil to be allowed to flow through the cooling unit 13.

Consequently, the membership functions P1 to P3 can be associated with changing the position of the regulating valve 15 such that oil is allowed to flow through the bypass pipe 14, whereas the membership functions P4 to P6 can be associated with changing the position of the regulating valve 15 such that oil is allowed to flow through the cooling unit 13.

In the particular example illustrated in FIG. 4, the changing of the position of the regulating valve 15 should be understood as rotating the central rotating element 26, but such an example should not be considered limiting.

In yet another embodiment according to the present invention, the absolute value of the first predetermined speed rate, −L, is equal with the absolute value of the sixth predetermined speed rate, +L, the absolute value of the second predetermined speed rate, −M, is equal with the absolute value of the fifth predetermined speed rate, +M, the absolute value of the third predetermined speed rate, −S, is equal with the absolute value of the fourth predetermined speed rate, +S.

In yet another embodiment, the absolute value of the first predetermined speed rate, −L, can be lower than the absolute value of the sixth predetermined speed rate, +L, and/or the absolute value of the second predetermined speed rate, −M, can be lower than the absolute value of the fifth predetermined speed rate, +M, and/or the absolute value of the third predetermined speed rate, −S, can be lower than the absolute value of the absolute value of the fourth predetermined speed rate, +S.

As an example, and not limiting thereto, the absolute value of the first predetermined speed rate, −L, and/or the absolute value of the sixth predetermined speed rate, +L, can be selected as any value within the interval [0.5; 1.5] %/s, such as for example approximately 0.8%/s, or approximately 0.9%/s, or even approximately 1.4%/s. Similarly, the absolute value of the second predetermined speed rate, −M, and/or the absolute value of the fifth predetermined speed rate, +M, can be selected as any value within the interval (0;

1] %/s such as for example approximately 0.2%/s, or approximately 0.3%/s, or even approximately 0.8%/s. Similarly, the absolute value of the third predetermined speed rate, −S, and/or of the fourth predetermined speed rate, +S, can be selected as any value within the interval (0; 0.5] %/s such as for example approximately 0.1%/s, or approximately 0.2%/s, or even approximately 0.4%/s.

In the context of the present invention, such examples should not be considered limiting in any way, and it should be understood that other values for the respective speed rates can be selected, without departing from the scope of the present invention.

For determining with how much the opening degree of such regulating valve 15 should be changed, towards the bypass pipe 14 or the cooling unit 13, or for the particular example of FIG. 4, for determining the angle with which the position of the regulating valve 15 is to be changed, the fuzzy logic algorithm applies a first control function, CTR_valve, and determines the minimum between the value 1 and the result of adding the fuzzy value associated with the second error, $e_2$, multiplied by a first coefficient, f1, to the fuzzy value associated with the evolution of the error, d(error)/dt, multiplied by a second coefficient, f2:

$$CTR_\text{valve}=\text{MIN}[f1\cdot FV(e_2)+f2\cdot FV(d(\text{error})/dt);1] \quad \text{(equation 8)},$$

whereby FV(e2) stands for the fuzzy value associated with the second error, e2, and FV(d(error)/dt) stands for the fuzzy value associated with the evolution of the error, d(error)/dt.

Said first coefficient, f1, and said second coefficient, f2 can be chosen such that the controller unit 20 can respond more rapidly or less rapidly to changes in error and/or in the evolution of the error, d(error)/dt.

Accordingly, if the second coefficient, f2, is selected as a relatively bigger value than the first coefficient, f1, the fuzzy logic algorithm will instruct the controller unit 20 to change the position of the regulating valve 15 whenever a relatively small change of outlet temperature, $T_{out}$, is detected. A compressor or vacuum pump 1 implementing such a method would be very responsive to small changes in outlet temperatures, $T_{out}$, but would also be less stable.

On the other hand, if the second coefficient, f2, is selected as a relatively smaller value than the first coefficient, f1, the fuzzy logic algorithm will instruct the controller unit 20 to change the position of the regulating valve 15 whenever a more significant change of the outlet temperature, $T_{out}$, is detected. A compressor or vacuum pump 1 implementing such a method would be less responsive to small changes in outlet temperatures, $T_{out}$, but would be more stable.

In another embodiment according to the present invention, the first coefficient, f1, and the second coefficient, f2, can be any real number selected between the interval (0; 1].

Preferably, but not limiting thereto, the first coefficient, f1, can be any real number selected between [0.5; 1], and the second coefficient, f2, can be any real number selected between (0; 0.5].

As an example, but not limiting thereto, for achieving a very efficient and stable compressor or vacuum pump 1, said first coefficient f1 can be selected as being equal to the value one, and the second coefficient, f2, can be selected as being equal to the value zero point two (0.2).

Accordingly, equation 8 becomes:

$$\text{CTR_valve}=\text{MIN}[1\cdot FV(e_2)+0.2\cdot FV(d(\text{error})/dt);\mathbf{1}] \quad \text{(equation 9)}.$$

In another embodiment according to the present invention, for determining the angle with which the position of the regulating valve 15 is to be changed, the fuzzy logic algorithm determines the maximum between the result of multiplying the fuzzy value associated with the second error, $e_2$, and a first coefficient, f1, and the result of multiplying the fuzzy value associated with the evolution of the error, d(error)/dt, and a second coefficient, f2:

$$CTR_\text{valve}=\text{MAX}[f1\cdot FV(e_2);f2\cdot FV(d(\text{error})/dt)] \quad \text{(equation 10)}.$$

In the context of the present invention, if the regulating valve comprises a central rotating element 26, then by determining the angle with which the position of the modulating valve 15 is to be changed, should be understood as determining the angle with which the central rotating element 26 is to be rotated.

In yet another embodiment according to the present invention, the fuzzy logic algorithm determines the angle with which the position of the regulating valve 15 is to be changed, by either determining the minimum between the fuzzy value associated with the second error, $e_2$, and the fuzzy value associated with the evolution of the error, d(error)/dt, or by determining the maximum between the fuzzy value associated with the second error, $e_2$, and the fuzzy value associated with the evolution of the error, d(error)/dt. Tests have shown that such an approach would lead to either a less responsive but stable compressor or vacuum pump 1, or a very responsive and less stable compressor or vacuum pump 1, respectively.

Returning now to FIG. 7, it would be preferred that each membership function P1 to P6 is assigned for one combination between the error and the evolution of the error, d(error)/dt.

Accordingly, if the second error, $e_2$, is negative, N, and the evolution of the error, d(error)/dt, is negative, $\dot{N}$, the result of the first control function, CTR_valve, is to be represented within the P1 graph; whereas, if the second error, $e_2$, is negative, N, and the evolution of the error, d(error)/dt, is positive, $\dot{P}$, the result of the first control function, CTR_valve, is to be represented within the P2 graph; whereas if the second error, $e_2$, is approximately equal to zero, Z, and the evolution of the error, d(error)/dt, is negative, $\dot{N}$, the result of the first control function, CTR_valve, is to be represented within the P3 graph; whereas, if the second error, $e_2$, is approximately equal to zero, Z, and the evolution of the error, d(error)/dt, is positive, $\dot{P}$, the result of the first control function, CTR_valve, is to be represented within the P4 graph; whereas, if the second error, $e_2$, is positive, P, and the evolution of the error, d(error)/dt, is negative, $\dot{N}$, the result of the first control function, CTR_valve, is to be represented within the P5 graph; whereas, if the second error, $e_2$, is positive, P, and the evolution of the error, d(error)/dt, is positive, $\dot{P}$, the result of the first control function, CTR_valve, is to be represented within the P6 graph.

Further, for determining one angle with which the regulating valve 15 should be changed, the fuzzy logic algorithm preferably comprises the step of determining the center of gravity of the graph determined after the result of the first control function, CTR_valve, is interposed with the respective membership function of FIG. 7, such center of gravity being further projected on the %/s axis.

Said %/s axis representing the angle with which the regulating valve 15 should be changed over one second.

If the center of gravity projected on the %/s axis falls in the range between (0; +x] or higher, the angle of the regulating valve 15 should be changed such that a bigger volume of oil is allowed to flow through the cooling unit 13 and at a speed rate corresponding to the respective membership function.

If the center of gravity projected on the %/s axis falls in the range between [−x; 0) or less, the angle of the regulating valve 15 should be changed such that a bigger volume of oil is allowed to flow through the bypass pipe 14 and at a speed rate corresponding to the respective membership function.

In an embodiment according to the present invention, depending on the required responsiveness of the overall system, the values of −x and +x can be any value selected between for example [−0.5; −20] and [+0.5; +20] respectively, more preferably, the values of −x and +x can be any value selected between [−1; −10] and [+1; +10] respectively; even more preferably, −x can be selected as being approximately −5, whereas +x can be selected as being approximately +5.

Further depending on the designer's specifications, the intermediate values −x1, −x2 can be defined within the interval [−x; 0) and +x1, +x2 can be defined within the interval (0; +x].

As an example, and not limiting thereto, −x1 can be selected as approximately −1, whereas −x2 can be selected as approximately −2. Similarly, +x1 can be selected as approximately +1, whereas +x2 can be selected as approximately +2.

It should be understood that such values can be experimentally determined, and the present invention should not be limited to the particular examples defined above.

In another embodiment according to the present invention the fuzzy logic algorithm further comprises the step of determining a position of the regulating valve 15 by applying the calculated angle, or the center of gravity projected on the %/s axis, to a current position of the regulating valve 15 preferably at a speed rate corresponding to the respective membership function.

Figure 8:
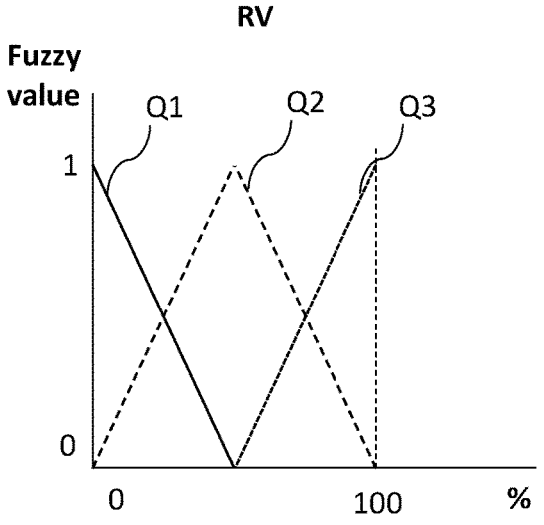
FIG. 8 schematically represents the graphical representation of the membership functions associated with the position of the regulating valve (RV) according to an embodiment of the present invention.

Accordingly, FIG. 8 illustrates the current position of the regulating valve 15 to which the result determined previously with respect to FIG. 7 is applied.

The membership functions of FIG. 8 being represented as the corresponding fuzzy values and as a function of the angle of rotation, represented in percentage, %.

Preferably, but not limiting thereto, if by applying the result determined with respect to FIG. 7, the modulating valve 15 reaches a position in which the oil is flowing mainly through the bypass pipe 14, the result should be represented within the graph Q1.

Further, if by applying the result determined with respect to FIG. 7, the modulating valve 15 reaches a position in which the oil is flowing partially through the bypass pipe 14 and partially through the cooling unit 13, then the result should be represented within graph Q2.

Whereas, if by applying the result determined with respect to FIG. 7, the modulating valve 15 reaches a position in which the oil is flowing mainly through the cooling unit 13, the result should be represented within graph Q3.

In another embodiment according to the present invention, the responsiveness of the system can be influenced by controlling when the fan 21 is started. Accordingly, for a more responsive system, if either one of or even all the graphs Q1 to Q3 are shifted towards the left hand side, on the % axis in FIG. 8, the fan 21 is started sooner, whereas if either one of or even all of the graphs Q1 to Q3 are shifted towards the right hand side, on the % axis in FIG. 8, the fan 21 is started later. If the compressor or vacuum pump comprises an energy recovering unit 25, the current position of the regulating valve 15 to which the result determined previously with respect to FIG. 7 is applied, is represented within FIG. 9.

Figure 9:
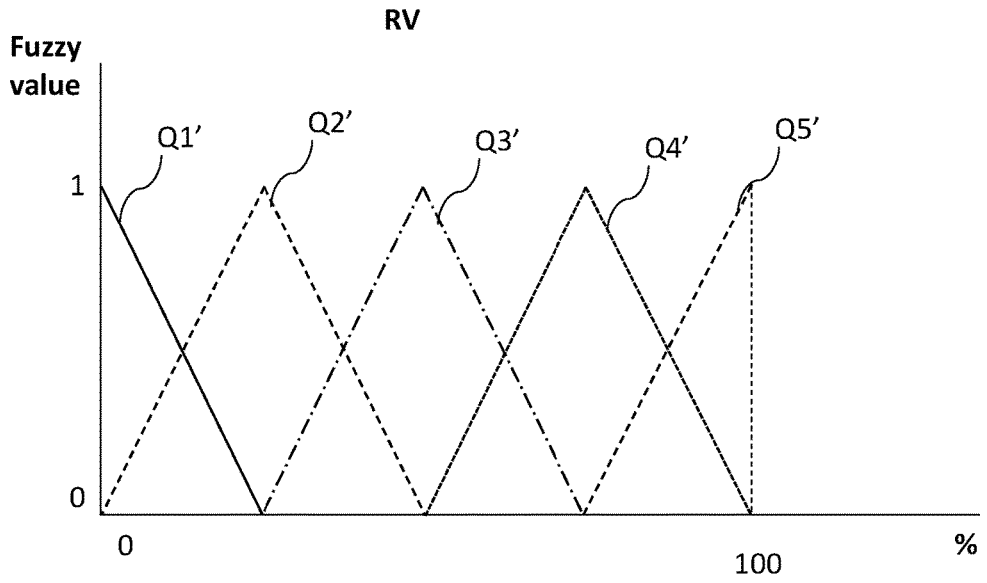
FIG. 9 schematically represents the graphical representation of the membership functions associated with the position of the regulating valve (RV) according to another embodiment of the present invention.

The membership functions of FIG. 9 being represented as the corresponding fuzzy values and as a function of the angle of rotation, represented in percentage, %.

Accordingly, if by applying the result determined with respect to FIG. 7, the modulating valve 15 reaches a position in which the oil is flowing mainly through the bypass pipe 14, the result should be represented within the graph Q1'.

Further, if by applying the result determined with respect to FIG. 7, the modulating valve 15 reaches a position in which the oil is flowing partially through the bypass pipe 14 and partially through the energy recovering unit 25, the result should be represented within the graph Q2'.

Similarly, if by applying the result determined with respect to FIG. 7, the modulating valve 15 reaches a position in which the oil is flowing mainly through the energy recovering unit 25, the result should be represented within the graph Q3'.

If by applying the result determined with respect to FIG. 7, the modulating valve 15 reaches a position in which the oil is flowing partially through the energy recovering unit 25 and partially through the cooling unit 13, the result should be represented within the graph Q4'.

Whereas, if by applying the result determined with respect to FIG. 7, the modulating valve 15 reaches a position in which the oil is flowing mainly through the cooling unit 13, the result should be represented within the graph Q5'.

Preferably, when the compressor or vacuum pump 1 is started, the regulating valve 15 is preferably in a default position characterised by a zero rotation angle, as illustrated in FIG. 3 and in FIG. 4, case in which the oil is preferably mainly flowing through the bypass pipe 14. As the temperature of the oil gradually increases, the rotation angle is modified, gradually allowing a partial flow of oil through the bypass pipe 14 and a partial flow of oil through the cooling unit 13, until reaching a maximum rotation angle of one hundred percent, case in which oil is mainly flowing thorough the cooling unit 13.

If the compressor or vacuum pump 1 does not comprise an energy recovering unit 25, then the one hundred percent rotation angle is preferably corresponding to a 90° physical rotation of the regulating valve 15. As illustrated in FIG. 4, the 90° physical rotation of the regulating valve 15 would correspond to a rotation of the central rotating element 26 according to arrow AA', by bringing axis I over axis II. Consequently, for returning to the initial position of zero rotation angle the central rotating element 26 would need to rotate according to arrow AA' but in the opposite direction, by bringing axis II over axis I.

In other words, for allowing oil to flow partially through the bypass pipe 14 and partially through the cooling unit 13 or mainly though the cooling unit 13, the central rotating element 26 should be rotated according to arrow AA' in a counter-clockwise direction, whereas if from such a position the central rotating element 26 would need be brought in an intermediary position or in the initial zero rotating angle, said central rotating element 26 should be rotated according to arrow AA' in a clockwise direction.

If the compressor or vacuum pump 1 comprises an energy recovering unit 25, then the one hundred percent rotation angle is corresponding to an 180° physical rotation angle of the regulating valve 15. As illustrated in FIG. 3, the 180° physical rotation angle of the regulating valve 15 would correspond to a rotation of the central rotating element 26 according to arrow BB', by bringing axis I over axis III. Consequently, for returning to the initial position of zero rotation angle the central rotating element 26 would need to rotate according to arrow BB' but in the opposite direction, by bringing axis III over axis I.

In other words, for allowing oil to flow partially through the bypass pipe 14 and partially through the energy recovering unit 25, or mainly through the energy recovering unit 25, or partially through the cooling unit 13 and partially through the energy recovering unit 25, or mainly through the cooling unit 13, the central rotating element 26 should be rotated according to arrow BB' in a counter-clockwise direction, whereas if from such a position the central rotating element 26 would need be brought in an intermediary position or in the initial zero rotating angle, said central rotating element 26 should be rotated according to arrow BB' in a clockwise direction.

It should be further understood that when the position of the regulating valve 15 is changed, the calculated angle is applied to the current angle of the regulating valve 15, according to arrow AA' or BB' and either modifying the rotation of the central rotating element 26 in a clockwise direction or in a counter-clockwise direction.

In another embodiment according to the present invention, the fuzzy logic algorithm is determining if the speed of the fan 21 should be increased or decreased based on the determined position of the regulating valve 15, the second error, e2, and the evolution of the error, d(error)/dt.

Because the fuzzy logic algorithm has as input parameter the position of the regulating valve 15, the speed of the fan 21 is modified in accordance with the volume of fluid reaching the cooling unit 13, increasing the energy efficiency of the compressor or vacuum pump 1 and prolonging the lifetime of the fan 21 and of the motor 24.

Depending on the second error, $e_2$, and the evolution of the error, d(error)/dt, the speed of the fan 21 would possibly have to be changed at a faster or at a slower rate.

Accordingly, in one embodiment according to the present invention, the fuzzy logic algorithm further determines the rate at which the speed of the fan 21 is to be changed by applying one or more of the following steps and checks: if the error is negative, N, and the evolution of the error, d(error)/dt, is negative, $\dot{N}$, then: if the position of the regulating valve 15 is such that oil is allowed to flow mainly through the bypass pipe 14, then the speed of the fan is to be decreased at a first speed rate, S; or if the position of the regulating valve 15 is such that oil is allowed to flow partially through the bypass pipe 14 and partially through the cooling unit 13, then the speed of the fan 21 is to be decreased at a second speed rate, MS; or if the position of the regulating valve 15 is such that oil is allowed to flow mainly through the cooling unit 13, then the speed of the fan 21 is to be decreased at a second speed rate, MS.

Further, if the error is negative, N, and the evolution of the error, d(error)/dt, is positive, $\dot{P}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the cooling unit 13, then the speed of the fan 21 is to be changed at a third speed rate, M; or if the position of the regulating valve 15 is such that oil is allowed to flow mainly through the cooling unit 13, then the speed of the fan 21 is to be changed at a third speed rate, M.

Further, if the error is approximately equal to zero, Z, and the evolution of the error, d(error)/dt, is negative, $\dot{N}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the cooling unit 13, then the speed of the fan 21 is to be decreased at a first speed rate, S; or if the position of the regulating valve 15 is such that oil is allowed to flow mainly through the cooling unit 13, then the speed of the fan 21 is to be decreased at a first speed rate, S.

Further, if the error is approximately equal to zero, Z, and the evolution of the error, d(error)/dt, is positive, $\dot{P}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the cooling unit 13, then the speed of the fan 21 is to be increased at a fourth speed rate, F; or if the position of the regulating valve 15 is such that oil is allowed to flow mainly through the cooling unit 13, then the speed of the fan 21 is to be increased at a fourth speed rate, F.

Further, if the error is positive, P, and the evolution of the error, d(error)/dt, is negative, $\dot{N}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the cooling unit 13, then the speed of the fan 21 is to be changed at a third speed rate, M; or if the position of the regulating valve 15 is such that oil is allowed to flow mainly through the cooling unit 13, then the speed of the fan 21 is to be changed at a third speed rate, M.

Further, if the error is positive, P, and the evolution of the error, d(error)/dt, is positive, $\dot{P}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the cooling unit 13, then the speed of the fan 21 is to be increased at a fourth speed rate, F; or if the position of the regulating valve 15 is such that oil is allowed to flow mainly through the cooling unit 13, then the speed of the fan 21 is to be increased at a fifth speed rate, MF.

Figure 10:
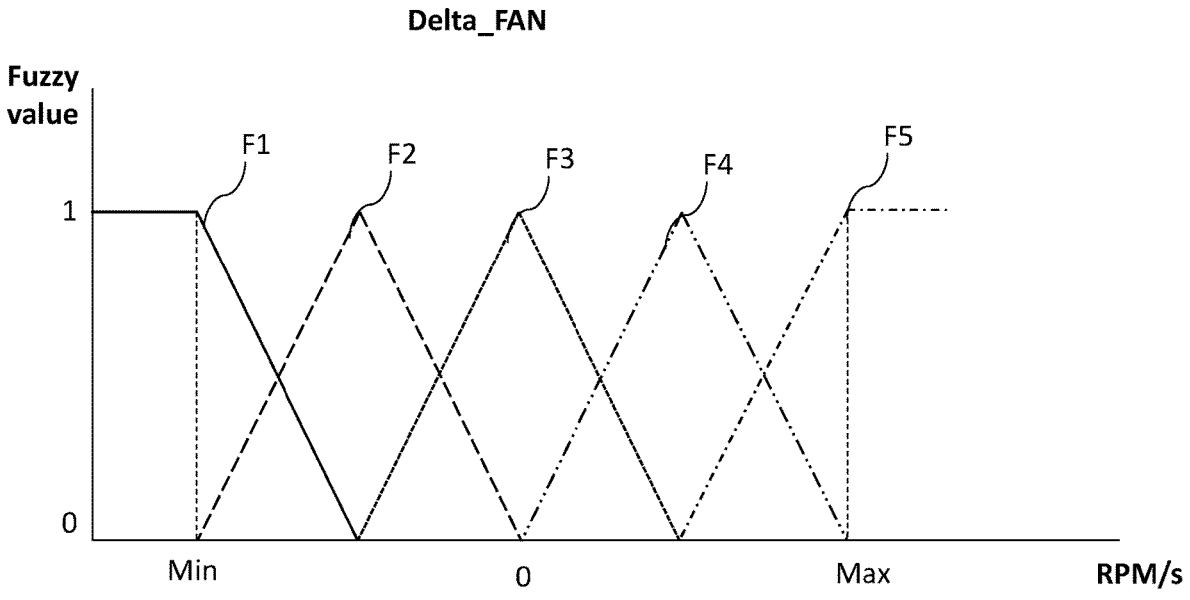
FIG. 10 schematically represents the graphical representation of the membership functions associated with the change of the speed of the fan (Delta FAN) according to an embodiment of the present invention.

As an example and not limiting thereto, the rate at which the speed of the fan 21 is to be changed is governed by the Table 3, wherein RV represents the position of the regulating valve and F1 to F5 are the membership functions as illustrated in FIG. 10.

TABLE 3

| | | [error;d(error)/dt] | | | | | |
|---|---|---|---|---|---|---|---|
| delta_FAN | | [N;$\dot{N}$ | [N;$\dot{P}$] | [Z;$\dot{N}$] | [Z;$\dot{P}$] | [P;$\dot{N}$] | [P;$\dot{P}$] |
| RV | Q1 (Z) | F2 (S) | F2 (S) | F2 (S) | F2 (S) | F2 (S) | F2 (S) |
| | Q2 (M) | F1 (MS) | F3 (M) | F2 (S) | F4 (F) | F3 (M) | F4 (F) |
| | Q3 (L) | F1 (MS) | F3 (M) | F2 (S) | F4 (F) | F3 (M) | F5 (MF) |

In another embodiment according to the present invention, if the compressor or vacuum pump 1 comprises an energy recovering unit 25, the fuzzy logic algorithm further determines the rate at which the speed of the fan 21 is to be changed by applying one or more of the following steps and checks: if the error is negative, N, and the evolution of the error, d(error)/dt, is negative, $\dot{N}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the energy recovering unit 25, then the speed of the fan 21 is to be decreased at a first speed rate, S; or if the position of the regulating valve 15 is such that oil is allowed to flow mainly through the energy recovering unit 25, then the speed of the fan 21 is to be decreased at a first speed rate, S; or if the position of the regulating valve 15 is such that oil is allowed to flow partially through the energy recovering unit 25 and partially through the cooling unit 13, then the speed of the fan 21 is to be decreased at a second speed rate, MS; or if the position of the regulating valve 15 is such that oil is allowed to flow mainly though the cooling unit 13, then the speed of the fan 21 is to be decreased at a second speed rate, MS.

Further, if the error is negative, N, and the evolution of the error, d(error)/dt, is positive, $\dot{P}$, then if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the energy recovering unit 25, then the speed of the fan 21 is to be decreased at a first speed rate, S; or if the position of the regulating valve 15 is such that oil is allowed to flow mainly through the energy recovering unit 25, then the speed of the fan 21 is to be decreased at a first speed rate, S; or if the position of the regulating valve 15 is such that oil is allowed to flow partially through the energy recovering unit 25 and partially through the cooling unit 13, then the speed of the fan is to be changed at a third speed rate, M; or if the position of the regulating valve 15 is such that oil is allowed to flow mainly though the cooling unit 13, then the speed of the fan 21 is to be changed at a third speed rate, M.

Further, if the error is approximately equal to zero, Z, and the evolution of the error, d(error)/dt, is negative, $\dot{N}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the energy recovering unit 25, then the speed of the fan 21 is to be decreased at a first speed rate, S; or if the position of the regulating valve 15 is such that oil is allowed to flow mainly through the energy recovering unit 25, then the speed of the fan 21 is to be decreased at a first speed rate, S; or if the position of the regulating valve 15 is such that oil is allowed to flow partially through the energy recovering unit 25 and partially through the cooling unit 13, then the speed of the fan 21 is to be decreased at a first speed rate, S; if the position of the regulating valve 15 is such that oil is allowed to flow mainly though the cooling unit 13, then the speed of the fan 21 is to be decreased at a first speed rate.

Further, if the error is approximately equal to zero, Z, and the evolution of the error, d(error)/dt, is positive, $\dot{P}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the energy recovering unit 25, then the speed of the fan 21 is to be decreased at a first speed rate, S; or if the position of the regulating valve 15 is such that oil is allowed to flow mainly through the energy recovering unit 25, then the speed of the fan 21 is to be decreased at a first speed rate, S; or if the position of the regulating valve 15 is such that oil is allowed to flow partially through the energy recovering unit 25 and partially through the cooling unit 13, then the speed of the fan 21 is to be increased at a fourth speed rate, F; or if the position of the regulating valve 15 is such that oil is allowed to flow mainly though the cooling unit 13, then the speed of the fan 21 is to be increased at a fourth speed rate, F.

Further, if the error is positive, P, and the evolution of the error, d(error)/dt, is negative, $\dot{N}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the energy recovering unit 25, then the speed of the fan 21 is to be decreased at a first speed rate, S; or if the position of the regulating valve 15 is such that oil is allowed to flow mainly through the energy recovering unit 25, then the speed of the fan 21 is to be decreased at a first speed rate, S; or if the position of the regulating valve 15 is such that oil is allowed to flow partially through the energy recovering unit 25 and partially through the cooling unit 13, then the speed of the fan 21 is to be changed at a third speed rate, M; or if the position of the regulating valve 15 is such that oil is allowed to flow mainly though the cooling unit 13, then the speed of the fan 21 is to be changed at a third speed rate, M.

Further, if the error is positive, P, and the evolution of the error, d(error)/dt, is positive, $\dot{P}$, then: if the position of the regulating valve 15 is such that oil is allowed to flow mainly through the bypass pipe 14, then the speed of the fan 21 is to be decreased at a first speed rate, S; or if the position of the regulating valve 15 is such that oil is allowed to flow partially through the bypass pipe 14 and partially through the energy recovering unit 25, then the speed of the fan 21 is to be decreased at a first speed rate, S; or if the position of the regulating valve 15 is such that oil is allowed to flow mainly through the energy recovering unit 25, then the speed of the fan 21 is to be decreased at a first speed rate, S; or if the position of the regulating valve 15 is such that oil is allowed to flow partially through the energy recovering unit 25 and partially through the cooling unit 13, then the speed of the fan 21 is to be increased at a fourth speed rate, F; or if the position of the regulating valve 15 is such that oil is allowed to flow mainly though the cooling unit 13, then the speed of the fan 21 is to be increased at a fifth speed rate, MF.

As an example and not limiting thereto, if the compressor or vacuum pump comprises an energy recovering unit 25, the rate at which the speed of the fan 21 is to be changed is governed by the Table 4, wherein RV represents the position of the regulating valve and F1 to F5 are the membership functions as illustrated in FIG. 10.

TABLE 4

| | | [error;d(error)/dt] | | | | | |
|---|---|---|---|---|---|---|---|
| delta_FAN (ER) | | [N;$\dot{N}$] | [N;$\dot{P}$] | [Z;$\dot{N}$] | [Z;$\dot{P}$] | [P;$\dot{N}$] | [P;$\dot{P}$] |
| RV | Q1' (VZ) | F2 (S) | F2 (S) | F2 (S) | F2 (S) | F2 (S) | F2 (S) |
| | Q2' (Z) | F2 (S) | F2 (S) | F2 (S) | F2 (S) | F2 (S) | F2 (S) |

TABLE 4-continued

| | [error;d(error)/dt] | | | | | |
|---|---|---|---|---|---|---|
| delta_FAN (ER) | [N;Ṅ] | [N;Ṗ] | [Z;Ṅ] | [Z;Ṗ] | [P;Ṅ] | [P;Ṗ] |
| Q3' (M) | F2 (S) | F2 (S) | F2 (S) | F2 (S) | FS (S) | F2 (S) |
| Q4' (L) | F1 (MS) | F3 (M) | F2 (S) | F4 (F) | F3 (M) | F4 (F) |
| Q5' (VL) | F1 (MS) | F3 (M) | F2 (S) | F4 (F) | F3 (M) | F5 (MF) |

In another embodiment according to the present invention, but not limiting thereto, the absolute value of the second speed rate, MS, is smaller than or equal to the absolute value of the first speed rate, S, the absolute value of the first speed rate, S, is smaller than or equal to the absolute value of the third speed rate, M, the absolute value of the third speed rate, M, is smaller than or equal to the absolute value of the fourth speed rate, F, the absolute value of the fourth speed rate, F, is smaller than or equal to the absolute value of the fifth speed rate, MF.

In the context of the present invention it should be understood that other relations between the first speed rate, S, the second speed rate, MS, the third speed rate, M, the fourth speed rate, F, and the fifth speed rate, MF, are still possible without departing from the scope of the present invention.

Further, in another embodiment according to the present invention, such speed rates can be equal. Accordingly, MS=S=M=F=MF.

In yet another embodiment according to the present invention, the absolute value of the second speed rate, MS, can be equal with the absolute value of the fifth speed rate, MF, and/or the absolute value of the first speed rate, S, can be equal with the absolute value of the fourth speed rate, F.

In a further embodiment according to the present invention, the second speed rate, MS, can be equal in module with the fifth speed rate, MF, and/or the first speed rate, S, can be equal in module with the fourth speed rate, F.

Preferably, but not limiting thereto: |−MS|=|MF| and/or |−S|=|F|.

In yet another embodiment according to the present invention, the third speed rate, M, can very small or even negligible. More preferably, the third speed rate, M, is approximately zero.

Preferably, but not limiting thereto, the second speed rate, MS, and/or the first speed rate, S, is/are negative, which would mean that the actual speed of the fan 21 would de decreased; whereas the fourth speed rate, F, and/or the fifth speed rate, MF, is/are positive, which would mean that the actual speed of the fan 21 would be increased.

As an example, but not limiting thereto, if we consider that the speed of the fan 21 can vary between zero and one hundred revolutions per minute over one second (RPM/s), the first speed rate, S, and the second speed rate, MS can be chosen as any value comprised between −1 and −100 RPM/s; whereas, the fourth speed rate, F, and the fifth speed rate, MF, can be chosen as any value comprised between +1 and +100 RPM/s.

More preferably, the first speed rate, S, and the second speed rate, MS can be chosen as any value comprised between −5 and −50 RPM/s; whereas, the fourth speed rate, F, and the fifth speed rate, MF, can be chosen as any value comprised between +5 and +50 RPM/s, or more preferably between +5 and +40 RPM/s.

Even more preferably, the first speed rate, S, and the second speed rate, MS can be chosen as any value comprised between −10 and −30 RPM/s; whereas, the fourth speed rate, F, and the fifth speed rate, MF, can be chosen as any value comprised between +10 and +30 RPM/s.

As an example, but not limiting thereto, the first speed rate, S, can be chosen as being approximately −15 RPM/s, the second speed rate, MS, can be chosen as being approximately −40 RPM/s, the fourth speed rate, F, can be chosen as being approximately +5 RPM/s, and the fifth speed rate, MF, can be chosen as being approximately +15 RPM/s.

In another embodiment according to the present invention, the fuzzy logic algorithm comprises the step of determining the actual speed with which the fan should be changed by applying a second control function, CTR_fan, and determining the value of: the fuzzy value associated with the actual angle of the position of the regulating valve 15 multiplied by the result of: the fuzzy value associated with the error multiplied by a third coefficient, f3, to which the fuzzy value associated with the evolution of the error, d(error)/dt, multiplied by a fourth coefficient, f4, is added:

$$\text{CTR_fan}=FV(RV)\cdot[f3\cdot FV(\text{error})+f4\cdot FV(d(\text{error})/dt)] \quad \text{(equation 21).}$$

The third coefficient, f3, and the fourth coefficient, f4 being selected in the same manner as the first coefficient, f1, and the second coefficient, f2, of equation 7, and depending if the controller unit 20 should respond more rapidly or less rapidly to changes in the error and/or the evolution of the error, d(error)/dt.

Accordingly, the third coefficient, f3, and the fourth coefficient, f4, can be selected as any real value comprised within the interval (0; 1].

Preferably, but not limiting thereto, the third coefficient, f3, can be selected as any real value comprised within the interval [0.5; 1], whereas the fourth coefficient, f4, can be selected as any real value comprised within the interval (0;0.5].

As an example, and not limiting thereto, the third coefficient, f3, can be selected as approximately zero point seven (0.7) and the fourth coefficient, f4, can be selected as approximately zero point three (0.3). Accordingly, equation 11 becomes:

$$\text{CTR_fan}=FV(RV)\cdot[0.7\cdot FV(\text{error})+0.3\cdot FV(d(\text{error})/dt)] \quad \text{(equation 12).}$$

The result of such equation is preferably further interposed with the graph of FIG. 10, wherein, the membership functions F1 to F5 are preferably assigned for one combination between the error and the evolution of the error, d(error)/dt, and further considering the actual position of the regulating valve 15.

Accordingly, if the error is negative, N, the evolution of the error, d(error)/dt, is negative, Ṅ, and if the regulating valve 15 allows a flow of oil mainly through the bypass pipe 14, then the result of the second control function, CTR_fan, is to be represented within the F2 graph; whereas, if the regulating valve 15 allows a flow of oil either partially through the bypass pipe 14 and partially through the cooling unit 13 or mainly through the cooling unit 13, then the result of the second control function, CTR_fan, is to be represented within the F1 graph.

If the error is negative, N, the evolution of the error, d(error)/dt, is positive, Ṗ, and if the regulating valve 15 allows a flow of oil mainly though the bypass pipe 14, then the result of the second control function, CTR_fan, is to be represented within the F2 graph; whereas if the regulating valve 15 allows a flow of oil either partially through the bypass pipe 14 and partially through the cooling unit 13 or mainly through the cooling unit 13, then the result of the second control function, CTR_fan, is to be represented within the F3 graph.

If the error is approximately equal to zero, Z, the evolution of the error, d(error)/dt, is negative, Ṅ, and the regulating valve 15 allows a flow of oil either mainly through the bypass pipe 14, or partially through the bypass pipe 14 and partially through the cooling unit 13, or mainly through the cooling unit 13, then the result of the second control function, CTR_fan, is to be represented within the F2 graph.

If the error is approximately equal to zero, Z, the evolution of the error, d(error)/dt, is positive, Ṗ, and if the regulating valve 15 allows the flow of oil mainly through the bypass pipe 14, then the result of the second control function, CTR_fan, is to be represented within the F2 graph; whereas if the regulating valve 15 allows the flow of oil either partially through the bypass pipe 14 and partially through the cooling unit 13 or mainly through the cooling unit 13, then the result of the second control function, CTR_fan, is to be represented within the F4 graph.

If the error is positive, P, the evolution of the error, d(error)/dt, is negative, Ṅ, and the regulating valve 15 is allowing a flow of oil mainly through the bypass pipe 14, then the result of the second control function, CTR_fan, is to be represented within the F2 graph; whereas, if the regulating valve 15 is allowing a flow of oil either partially through the bypass pipe 14 and partially through the cooling unit 13 or fully through the cooling unit 13, then the result of the second control function, CTR_fan, is to be represented within the F3 graph.

If the error is positive, P, the evolution of the error, d(error)/dt, is positive, Ṗ, and if the regulating valve is allowing a flow of oil mainly through the bypass pipe 14, then the result of the second control function, CTR_fan, is to be represented within the F2 graph;

whereas, if the regulating valve 15 is allowing a flow of oil partially through the bypass pipe 14 and partially through the cooling unit 13, then the result of the second control function, CTR_fan, is to be represented within the F4 graph; whereas if the regulating valve 15 is allowing a flow of oil mainly through the cooling unit 13, then the result of the second control function, CTR_fan, is to be represented within the F5 graph.

In another embodiment according to the present invention, if the oil injected compressor or vacuum pump 1 comprises an energy recovering unit 25, then the result of the second control function, CTR_fan, is preferably further interposed with the graph of FIG. 10, wherein, the membership functions F1 to F5 are preferably assigned for a combination between the error and the evolution of the error, d(error)/dt, as will be further explained.

If the error is negative, N, the evolution of the error, d(error)/dt, is negative, Ṅ, and the regulating valve 15 is allowing a flow of oil either mainly through the bypass pipe 14, or partially through the bypass pipe 14 and partially through the energy recovering unit 25, or mainly through the energy recovering unit 25, then the result of the second control function, CTR_fan, is to be represented within the F2 graph; whereas, if the regulating valve 15 is allowing a flow of oil either partially through the energy recovering unit 25 and partially through the cooling unit 13, or mainly through the cooling unit 13, then the result of the second control function, CTR_fan, is to be represented within the F1 graph.

If the error is negative, N, the evolution of the error, d(error)/dt, is positive, Ṗ, and if the regulating valve 15 allows a flow of oil either mainly through the bypass pipe 14, or partially through the bypass pipe 14 and partially through the energy recovering unit 25, or mainly through the energy recovering unit 25, then the result of the second control function, CTR_fan, is to be represented within the F2 graph; whereas, if the regulating valve 15 is allowing a flow of oil either partially through the energy recovering unit 25 and partially through the cooling unit 13 or mainly through the cooling unit 13, then the result of the second control function, CTR_fan, is to be represented within the F3 graph.

If the error is approximately equal to zero, Z, the evolution of the error, d(error)/dt, is negative, Ṅ, and the regulating valve 15 allows a flow of oil either mainly through the bypass pipe 14, or partially through the bypass pipe 14 and partially through the energy recovering unit 25, or mainly through the energy recovering unit 25, or partially through the energy recovering unit 25 and partially through the cooling unit 13, or mainly through the cooling unit 13, then the result of the second control function, CTR_fan, is to be represented within the F2 graph.

If the error is approximately equal to zero, Z, the evolution of the error, d(error)/dt, is positive, Ṗ, and if the regulating valve 15 is allowing a flow of oil either mainly through the bypass pipe 14, or partially through the bypass pipe 14 and partially through the energy recovering unit 25, or mainly through the energy recovering unit 25, then the result of the second control function, CTR_fan, is to be represented within the F2 graph; whereas, if the regulating valve 15 is allowing a flow of oil either partially through the energy recovering unit 25 and partially through the cooling unit 13 or mainly through the cooling unit 13, then the result of the second control function, CTR_fan, is to be represented within the F4 graph.

If the error is positive, P, the evolution of the error, d(error)/dt, is negative, Ṅ, and if the regulating valve 15 is allowing a flow of oil either mainly through the bypass pipe 14, or partially through the bypass pipe 14 and partially through the energy recovering unit 25, or mainly through the energy recovering unit 25, then the result of the second control function, CTR_fan, is to be represented within the F2 graph; whereas, if the regulating valve 15 is allowing a flow of oil either partially through the energy recovering unit 25 and partially through the cooling unit 13, or mainly through the cooling unit 13, then the result of the second control function, CTR_fan, is to be represented within the F3 graph.

If the error is positive, P, the evolution of the error, d(error)/dt, is positive, Ṗ, and the regulating valve 15 is allowing a flow of oil to either mainly through the bypass pipe 14, or partially through the bypass pipe 14 and partially through the energy recovering unit 25, or mainly through the energy recovering unit 25, then the result of the second control function, CTR_fan, is to be represented within the F2 graph; whereas, if the regulating valve 15 is allowing a flow of oil partially through the energy recovering unit 25 and partially through the cooling unit 13, then the result of the second control function, CTR_fan, is to be represented within the F4 graph; whereas, if the regulating valve 15 is allowing a flow of oil mainly through the cooling unit 13, then the result of the second control function, CTR_fan, is to be represented within the F5 graph.

In a further embodiment according to the present invention, after the second control function, CTR_fan, has been interposed with the graph of FIG. 10, the fuzzy logic algorithm is preferably calculating the center of gravity of the resulting graph and projects it on the RPM/s (revolutions per minute/second) axis.

Consequently, the fuzzy logic algorithm determines the actual speed with which the speed of the fan 21 is to be changed.

If such a speed would need to be decreased, the center of gravity projected onto the RPM/s axis would be a value comprised between zero and a minimum value, Min. Preferably such value is comprised within the interval [−100; 0) RPM/s.

If the speed would need to be increased, the center of gravity projected onto the RPM/s axis would be a value comprised between zero and a maximum value, Max. Preferably such a value is comprised within the interval (0; 100] RPM/s.

Consequently, the controller unit 20 is increasing or decreasing the speed of the fan 21 according to the result of the determined actual speed and according to the speed rate associated to the respective membership function corresponding to the second control function, CTR_fan, when interposed with the graph of FIG. 10.

In the context of the present invention, the center of gravity of a graph should be understood as the mean position of all the points part of said graph and in all the coordinate directions. In other words, the center of gravity of a graph represents the balance point of such graph, or the point at which an infinitesimally thin cutout of the shape could be in perfect balance on a tip of a pin, assuming a uniform density of the cutout, within a uniform gravitational field.

It should be further understood that the fuzzy logic algorithm can apply any method for determining such center of gravity, and the present invention should not be limited to any such particular method.

As an example, but without limiting thereto, the center of gravity can be calculated by considering the possible peaks of the representation of the first control function, CTR_valve, or the second control function, CTR_fan, respectively, interposed with the respective graphs. Such peaks being characterised by two coordinates (A; B), whereby A is part of the %/s axis of FIG. 7, or RPM/s axis of FIG. 10; and B is part of the value axis and comprised between [0; 1] of FIG. 7 or FIG. 10 respectively.

Considering such coordinates for each of the peaks within the respective membership functions, the center of gravity can be calculated to have the coordinates: mean A and mean B, whereby mean A represents the average of all the A coordinates of all the peaks, and mean B represents the average of all the B coordinates of all the peaks.

In another embodiment according to the present invention, the fuzzy logic algorithm can calculate the center of gravity of each graph corresponding to each membership function: either for P1 to P6, or for F1 to F5. The result being either five or six centers of gravity.

Further, the fuzzy logic algorithm can determine the actual angle with which the position of the modulating valve 15 should change by applying the following formula:

$$\frac{\sum_{i=1}^{6} \text{CTR_valve}_i * G_i}{\sum_{i=1}^{6} \text{CTR_valve}_i}, \quad \text{(equation 13)}$$

whereby $G_i$ represents the respective center of gravity, and whereby CTR_valve; represents the first control function applied for the respective membership functions, P1 to P6.

Similarly, the fuzzy logic algorithm can determine the actual speed with which the speed of the fan 21 should change by applying the following formula:

$$\frac{\sum_{i=1}^{5} \text{CTR_fan}_i * G_i}{\sum_{i=1}^{5} \text{CTR_fan}_i}, \quad \text{(equation 14)}$$

whereby $G_i$ represents the respective center of gravity, and whereby $\text{CTR_fan}_i$ represents the second control function applied for the respective membership functions, F1 to F5.

In the context of the present invention, 'partially' should be understood as any volume of oil selected between a minimum volume approximately equal to zero and a maximum volume approximately equal to one hundred percent, such as for example and not limiting thereto: approximately thirty percent, or approximately forty percent or even approximately sixty percent. More preferably 'partially' should be understood as a volume of oil representing approximately half, or fifty percent, of the volume of oil flowing through the oil outlet 11 and eventually reaching the oil inlet 12. It should be understood that such volume can be varied according to the requirements of the compressor or vacuum pump 1, such as for example between twenty five percent and seventy five percent.

Further, 'mainly' should be understood as approximately the entire volume, or approximately one hundred percent of the volume of oil flowing through the oil outlet 11 and eventually reaching the oil inlet 12.

Figure 11:
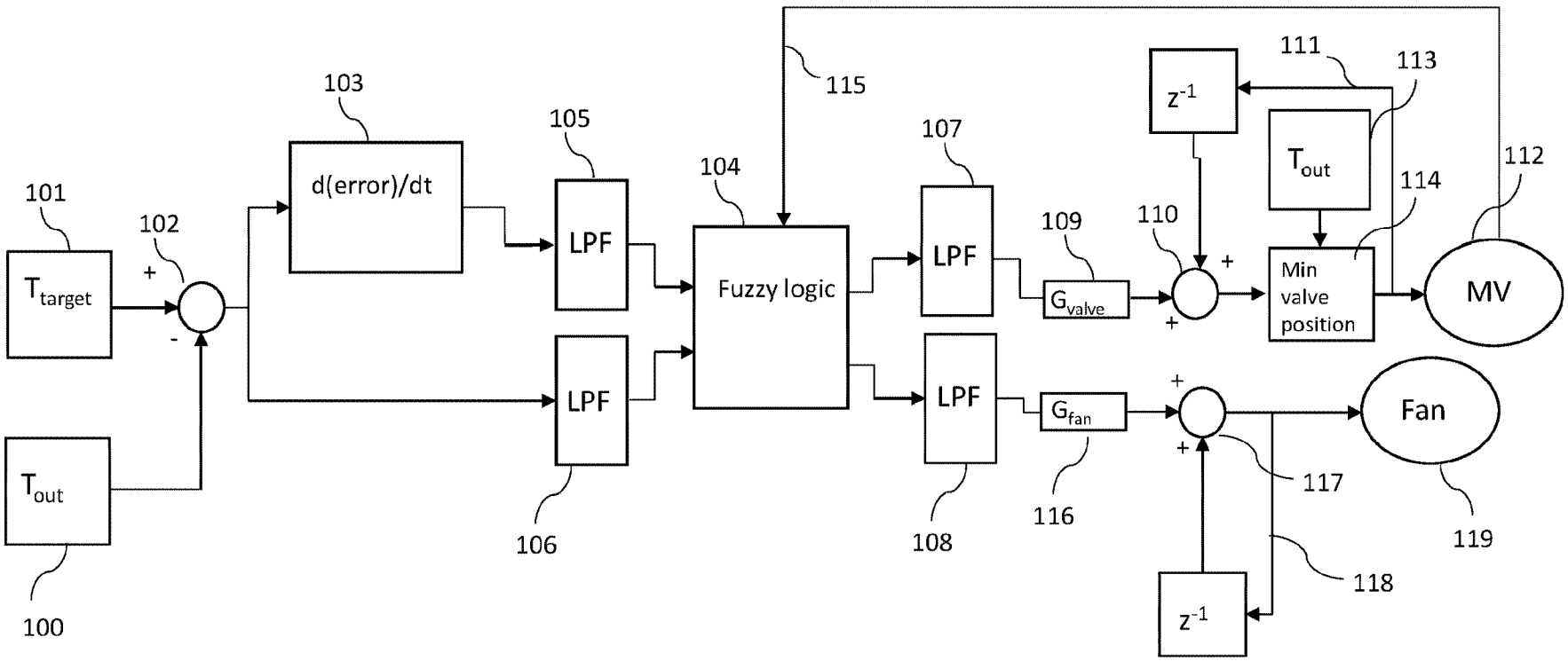
FIG. 11 schematically represents a control loop of the fuzzy logic algorithm according to an embodiment of the present invention.

As an example and without limiting thereto, FIG. 11 illustrates a control loop applied by the fuzzy logic algorithm.

Accordingly, the measured outlet temperature, $T_{out}$, provided by the outlet temperature sensor 18 is received in block 100, such received outlet temperature, $T_{out}$, being compared with the calculated predetermined target value, $T_{target}$ of block 101. The error is determined with the help of block 102.

Further the fuzzy logic algorithm calculates the evolution of the error, d(error)/dt, in block 103, and before reaching the fuzzy logic block 104, the short time temperature fluctuations are being filtered by LPFs 105 and 106.

Accordingly, the fuzzy logic block 104 receives as input: on the one side, filtered values of the error, and on the other side, filtered values of the evolution of such errors, d(error)/dt. Further, the fuzzy logic block 104 represents such values within the graphs illustrated in FIG. 5 and FIG. 6, according to the respective membership functions and as previously explained.

For an increased stability of the overall system, the control loop further filters the resulting values with the help of the filters in blocks 107 and 108 respectively, whereby very small fluctuations are ignored.

In a subsequent step, the fuzzy logic block 104 determines the direction in which the regulating valve 15 should be changed and the speed rate at which such a regulating valve 15 should be changed by using the graph of FIG. 7 and the first control function, CTR_valve.

According to the method described herein, the result of the first control function, CTR_valve, is preferably interposed with the respective membership function of FIG. 7, and the center of gravity of the resulting graph is being calculated and projected on the %/s axis. Such center of gravity projected on the %/s axis being represented in block 109 as an output of the fuzzy logic block 104.

Further, the fuzzy logic algorithm adds the determined center of gravity projected on the %/s axis to the current position of the regulating valve 15 with the help of block 110 and loop 111, and determines the new current position of said regulating valve 15 in block 112.

Preferably but not limiting thereto, for an even more stable overall system, the control loop can comprise blocks 113 and 114, whereby through block 113, the measured outlet temperature, $T_{out}$, is considered.

Block 114 determines a minimum position of the modulating valve 15 according to the outlet temperature, $T_{out}$. Preferably, in block 114, an experimentally determined graph is uploaded in which a minimum position of the valve at respective outlet temperatures, $T_{out}$, is represented.

Consequently, if after adding the determined center of gravity projected on the %/s axis to the current position of the regulating valve 15 with the help of block 110 and loop 111, such a newly determined position would have a smaller angle than the one determined on the graph of block 114 for the respective outlet temperature, $T_{out}$, then the fuzzy logic algorithm will select the value extracted from such graph and determine the new current position of said regulating valve 15 in block 112. Otherwise, the fuzzy logic algorithm would proceed as previously explained.

By applying these checks, the fuzzy logic algorithm helps in preventing the compressor or vacuum pump 1 from experiencing overshoots of temperature, which can turn out to be damaging. Consequently, blocks 113 and 114, help in avoiding the situation in which the compressor or vacuum pump 1 would run at a very low speed of the motor 7 and the temperature at the outlet, $T_{out}$, would become very high.

Furthermore, if the temperature at the outlet, $T_{out}$, would increase to very high values, the controller unit 20 would not allow for oil to flow through the bypass pipe 14, or only a very small quantity of oil would be allowed to flow therethrough.

Said new current position of the regulating valve 15 being an input of the fuzzy logic block 104, with the help of loop 115.

Using such new current position, said fuzzy logic block 104 further determines how the speed rate of the fan 21 is to be changed and the rate at which such a speed should be changed, by using the graph of FIG. 10 and the second control function, CTR_fan.

Accordingly, the result of the second control function, CTR_fan is preferably interposed with the respective membership function of FIG. 10, and the center of gravity of the resulting graph is being calculated and projected on the RPM/s axis. Such center of gravity projected on the RPM/s axis being represented in block 116 as another output of the fuzzy logic block 104.

Further, the fuzzy logic algorithm applies the sum between the current value of the speed of the fan 21 and the center of gravity projected on the RPM/s axis, with the help of block 117 and loop 118, and determines the new current speed of the fan 21 in block 119.

The new current position of the regulating valve 15 of block 110 and the new current speed of the fan 21 of block 115 being further used by the controller unit 20 as set values with which the position of the regulating valve 15 is influenced through the first data link 32 and with which the speed of the fan 21 is influenced through the second data link 33.

In the context of the present invention it should be understood that the technical features presented herein can be used in any combination without departing from the scope of the invention.

The present invention is by no means limited to the embodiments described as an example and shown in the drawings, but such an oil injected compressor or vacuum pump can be realized in all kinds of variants, without departing from the scope of the invention. Similarly, the invention is not limited to the method for maintaining the temperature at an outlet of an oil injected compressor or vacuum pump bellow a predetermined target value described as an example, however, said method can be realized in different ways while still remaining within the scope of the invention.

The invention claimed is:

1. A method for controlling an outlet temperature of an oil injected compressor or vacuum pump comprising a compressor or vacuum element provided with a gas inlet, an element outlet, and an oil inlet, said method comprising the steps of:

measuring an outlet temperature at the element outlet; and controlling a position of a regulating valve in order to regulate a flow of oil flowing through a cooling unit connected to said oil inlet;

wherein the step of controlling the position of the regulating valve comprises applying a fuzzy logic algorithm on the measured outlet temperature; and controlling a speed of a fan cooling the oil flowing through the cooling unit by applying the fuzzy logic algorithm, wherein the speed of the fan is controlled based on the position of the regulating valve and the measured outlet temperature.

2. The method according to claim 1, further comprising the step of measuring an inlet temperature, the inlet pressure at the gas inlet and the outlet pressure at the element outlet.

3. The method according to claim 2, wherein the controlling of the position of the regulating valve involves applying said fuzzy logic algorithm further on the measured inlet temperature, inlet pressure and the outlet pressure.

4. The method according to claim 1, wherein the step of controlling the position of said regulating valve involves regulating the flow of oil flowing through said cooling unit and through a bypass pipe fluidly connected said oil inlet, for bypassing the cooling unit.

5. The method according to 2, wherein the method further comprises the step of maintaining the outlet temperature at approximately a predetermined target value, said predetermined target value being calculated by determining an atmospheric dew point based on the measured inlet temperature, inlet pressure and outlet pressure and an estimated or measured relative humidity of the gas flowing through the gas inlet.

6. A method for controlling an outlet temperature of an oil injected compressor or vacuum pump comprising a compressor or vacuum element provided with a gas inlet, an element outlet, and an oil inlet, said method comprising the steps of:

measuring an outlet temperature at the element outlet; and controlling a position of a regulating valve in order to regulate a flow of oil flowing through a cooling unit connected to said oil inlet;

wherein the step of controlling the position of the regulating valve comprises applying a fuzzy logic algorithm on the measured outlet temperature; and the method further comprises the step of controlling a speed of a fan cooling the oil flowing through the cooling unit by applying the fuzzy logic algorithm based on the position of the regulating valve, wherein the method further comprises the step of measuring an inlet temperature, an inlet pressure at the gas inlet and an outlet pressure at the element outlet, wherein the method further comprises the step of maintaining the outlet temperature at approximately a predetermined target value, said predetermined target value being calculated by determining an atmospheric dew point based on the measured inlet temperature, inlet pressure and outlet pressure and an estimated or measured relative humidity of the gas flowing through the gas inlet, and wherein the fuzzy logic algorithm comprises the step of determining a first error by subtracting the predetermined target value from a first measured outlet temperature and determining a second error by subtracting the predetermined target value from a subsequent measured outlet temperature.

7. The method according to claim 6, wherein the fuzzy logic algorithm further comprises the step of calculating an evolution of the error, by calculating the derivative of the error over time, by subtracting the second error from the first error, and dividing it over a time interval, calculated between the moment when the first outlet temperature is measured, and the moment when the subsequent outlet temperature is measured.

8. The method according to claim 7, wherein the fuzzy logic algorithm further comprises the step of determining the direction towards which the position of the regulating valve should be changed based on the first error or the second error, and the evolution of the error.

9. The method according to claim 7, wherein the fuzzy logic algorithm further comprises the step of determining the speed rate with which the position of the regulating valve should be changed based on the first error or the second error, and the evolution of the error.

10. The method according to claim 7, wherein the fuzzy logic algorithm determines the direction in which the regulating valve is to be changed by applying:

if the second error is negative or if the second error is approximately equal to zero, and the evolution of the error is negative, the direction in which the position of the regulating valve is to be changed is such that more oil is flowing through the bypass pipe; or if the second error is positive or if the second error is approximately equal to zero, and the evolution of the error is positive, the direction in which the position of the regulating valve is to be changed is such that more oil is flowing through the cooling unit.

11. The method according to claim 9, wherein the fuzzy logic algorithm determines the speed rate with which the position of the regulating valve is to be changed according to one or more of the following steps:

if the second error is negative and the evolution of the error is negative, the position of the regulating valve is to be changed at a first predetermined speed rate;

if the second error is negative and the evolution of the error is positive, the position of the regulating valve is to be changed at a second predetermined speed rate;

if the second error is approximately equal to zero and the evolution of the error is negative, the position of the regulating valve is to be changed at a third predetermined speed rate;

if the second error is approximately equal to zero and the evolution of the error is positive, the position of the regulating valve is to be changed at a fourth predetermined speed rate;

if the second error is positive and the evolution of the error is negative, the position of the regulating valve is to be changed at a fifth predetermined speed rate;

if the second error is positive and the evolution of the error is positive, the position of the regulating valve is to be changed at a sixth predetermined speed rate.

12. The method according to claim 11, wherein the first predetermined speed rate is lower than the sixth predetermined speed rate; and/or the second predetermined speed rate is lower than the fifth predetermined speed rate; and/or the third predetermined speed rate is lower than the fourth predetermined speed rate.

13. The method according to claim 7, wherein the regulating valve comprises a central rotating element, the fuzzy logic algorithm determines the angle with which the position of the regulating valve is to be changed by applying a first control function, and determining the minimum between one and the result of adding a fuzzy value associated with the second error, multiplied by a first coefficient to a fuzzy value associated with the evolution of the error multiplied by a second coefficient.

14. The method according to claim 13, wherein the fuzzy logic algorithm further comprises the step of determining the position of the regulating valve by applying the calculated angle to a current position of the regulating valve.

15. The method according to claim 14, wherein the fuzzy logic algorithm is determining if the speed of the fan should be increased or decreased based on the determined position of the regulating valve, the second error and the evolution of the error.

16. The method according to claim 14, wherein the fuzzy logic algorithm comprises the step of determining the actual speed with which the speed of the fan should be changed by applying a second control function, and determining the value of a fuzzy value associated with an actual angle of the position of the regulating valve multiplied by the result of a fuzzy value associated with the second error multiplied by a third coefficient to which a fuzzy value associated with the evolution of the error multiplied by a fourth coefficient is added.

* * * * *